US009458991B2

(12) United States Patent
Jacksen et al.

(10) Patent No.: US 9,458,991 B2
(45) Date of Patent: Oct. 4, 2016

(54) OPTICAL FRAMING PROJECTOR FORWARD ACCESS ADJUSTMENT AND LOCKING SYSTEMS

(76) Inventors: Peter Jacksen, Los Alamos, CA (US); John Jacksen, Los Alamos, CA (US); Mark Jacksen, Monrovia, CA (US)

( * ) Notice: Subject to any disclaimer, the term of this patent is extended or adjusted under 35 U.S.C. 154(b) by 277 days.

(21) Appl. No.: 13/292,919

(22) Filed: Nov. 9, 2011

(65) Prior Publication Data

US 2012/0113648 A1 May 10, 2012

Related U.S. Application Data

(60) Provisional application No. 61/456,541, filed on Nov. 9, 2010.

(51) Int. Cl.
*F21V 11/18* (2006.01)
*F21W 131/406* (2006.01)

(52) U.S. Cl.
CPC ..... *F21V 11/18* (2013.01); *F21W 2131/406* (2013.01)

(58) Field of Classification Search
CPC ..... F21V 17/02; F21V 14/04; F21V 14/06; F21V 5/04; F21V 11/18; F21V 11/10; F21V 21/04; F21V 21/30; F21W 2131/406; F21S 8/02
USPC ..... 362/277, 268, 321, 364; 353/85, 88, 91, 353/95, 97
See application file for complete search history.

(56) References Cited

U.S. PATENT DOCUMENTS

| | | | | |
|---|---|---|---|---|
| 5,510,969 | A * | 4/1996 | Rodger et al. | 362/321 |
| 6,113,329 | A * | 9/2000 | Moroi et al. | 411/223 |
| 6,636,925 | B1 * | 10/2003 | Otsubo et al. | 710/305 |
| 6,832,845 | B1 * | 12/2004 | Kretzschmar et al. | 362/277 |
| 6,834,982 | B2 * | 12/2004 | Dedoro | 362/268 |
| 7,033,047 | B2 * | 4/2006 | Gennrich et al. | 362/321 |
| 7,517,088 | B1 * | 4/2009 | Kretzschmar et al. | 353/43 |
| 7,543,953 | B2 * | 6/2009 | Chapman | 362/205 |
| 7,670,072 | B2 * | 3/2010 | Tella et al. | 396/529 |
| 2011/0235337 | A1 | 9/2011 | Jacksen | |

* cited by examiner

*Primary Examiner* — Jong-Suk (James) Lee
*Assistant Examiner* — Mark Tsidulko

(57) ABSTRACT

The invention relates to a forward access optical framing projector assembly either forward of, or housed behind, a finished surface in which adjustments to the assembly can be made from the front end making it safer and easier to manage. The forward access design requires only a small opening behind a finished surface and can be adjusted by tool instead of hand. The invention has a light mask gate attached to a gate rotation sleeve, and a locking fastener parallel to the optical axis of the light source that pushes the light mask gate forward, making it possible to lock the light mask gate. A tool can be inserted into an opening in light masking shutters. Radial slots in a front cone flange combined with either a shutter gate with radial grooves or a nut retainer tab makes it possible to variably adjust and lock the light masking shutters.

17 Claims, 40 Drawing Sheets

OPTICAL FRAMING PROJECTOR FORWARD ACCESS ADJUSTMENT AND LOCKING SYSTEMS

CROSS-REFERENCE TO RELATED APPLICATION

This application claims the benefit of the priority filing date of provisional patent application No. 61/456,541 filed on Nov. 9, 2010.

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Optical framing projector assemblies are widely used in the architectural and theatrical lighting industries. Optical framing projector assemblies can be surface mounted onto the finished surface plane of a structure or recessed behind the finished surface plane of a structure. A large opening in the finished surface plane of a structure is required to facilitate side access to the various adjustment and locking features. After a recessed installation is complete, a removable trim plate covers the large opening in the finished surface plane of a structure and the trim plate includes an aperture opening for the light path to pass through.

Optical framing projector assemblies are used when precise illumination is desired. The subject is lit or pattern image projected by an optical framing projector assembly, making the subject appear magically illuminated. The distinguishing characteristic of an illumination produced by an optical framing projector assembly is that this magical light stops precisely at the edge of an illumination zone. In this high contrast binary illumination, the subject alone is bathed in light, while the surrounding area is dark.

An optical framing projector assembly confines and shapes light using a light mask. The confined and shaped light is focused using an objective focal lens resulting in a customized illumination zone shape on a surface where it can be seen. The light mask in an optical framing projector assembly can take many forms known and used today. The forms range from field adjustable light masking shutters, or mechanically adjusted iris-type devices, to pre-manufactured light masking plates or light masking plates that are created by technicians in the field as they cut or scrape away light masking material to allow shaped light to pass through. Light masks are used to for several purposes. For example, to create four-sided rectilinear shapes, such as for a painting; to create images, such as custom logos, stars, clouds, etc.; to follow the contour of irregularly shaped objects such as sculpture; and to project multiple beams of light from one projector having a light mask plate with multiple openings.

The light mask is positioned within a light mask slot located within the light mask gate of an optical framing projector assembly. The light mask gate is designed to receive one or more of the light mask forms described.

The light mask gate in an optical framing projector assembly is sometimes designed to rotate around the light axis. Projector systems that include a gate rotation feature will also include a gate rotation locking system. The gate rotation and locking features facilitate adjustment for various light mask forms in cases where the optical framing projector assembly is installed horizontally offset in relation to the illumination zone—in order to compensate for the offset distortion between the illumination zone shape and the light masking edge-opening shape.

For systems implementing a gate rotation feature, the light mask gate is rotated during final adjustment of an optical framing projector assembly and then locked into position using at least one fastener with a fastener body affixed to the side of a projector with the fastener orientated perpendicular to the light axis. Side access to the gate rotation locking fastener with the fastener orientated perpendicular to the light axis in a recessed optical framing projector assembly installation can be one of the causes for a larger opening requirement in the finished surface plane of a structure. The large, unsightly opening is necessary to give the installation technician sufficient access to work around the optical framing projector assembly—providing ample room for a hand and/or other fastener driver to be positioned perpendicular to light axis.

One specific light mask form known and used today is a light masking shutter. Usually four light masking shutters are installed perpendicular to the light path axis within the light mask slot of a light mask shutter gate. To reduce the risk of light masking shutters jamming into one another, a separator plate may sometimes be implemented to separate pairs of light masking shutters. Two opposing light masking shutters would then share one plane of the separator plate, and the other two perpendicular light masking shutters 180° off will share the opposite side of the separator plate on a different parallel plane.

Most optical framing projector assemblies do not include a shutter locking mechanism to secure light masking shutters. Each shutter is adjusted while often accidentally moving an opposing, previously adjusted light masking shutter resulting in illumination zone errors from a light masking shutter being miss-aligned to the desired illumination zone edge. Technicians must sometimes lock shutters into position using a wedge installed into the light mask slot positioned perpendicular to the light axis.

The objective focal lens is normally installed within an objective focal cone. The objective focal lens can be provided as a limited one-size-for-all, or be custom chosen to match the focal length requirements of individual installations. For a custom focal length, the goal is to produce an outbound light beam that is the correct diameter for the application by choosing one or more lenses with the correct focal length.

A light emitting diode or fiber optic light source is sometimes used, however, the light source for an optical framing projector assembly is usually halogen or metal halide. Both generate high levels of heat. The light source engages a lamp holder and the lamp holder is usually fastened to a back cap. The back cap often includes a closed design to eliminate light leaks into a recessed housing or onto the finished surface plane of a structure. Optical framing projector assemblies also often include a closed lamp housing design to minimize light leaks into a recessed housing or onto the finished surfaces plane of a structure.

A hot light source, combined with a closed lamp housing and closed back cap cause many optical framing projector assemblies to operate at very high temperatures. The high temperature makes it extremely difficult for technicians to adjust optical framing projector assemblies. The problem is exasperated when a closed design optical framing projector assembly is installed into a recessed housing behind the finished surface plane of a structure.

When adjusting the manually adjusted light masking shutter, technicians are exposed to the risk of burns.

In sum, current optical framing projection systems do not provide sufficient safety or safe access for technicians to work with or work around optical framing projection assemblies due to high temperature that can be compounded by insufficient opening space when behind a finished surface (unless an architect is willing to provide a large, unsightly space opening in a finished surface). The key objectives of the present invention are to improve technician access and safety when working with optical framing projection assemblies, while also minimizing the need to create large, unsightly openings in finished surfaces of a structure. These key objectives are achieved in the form of forward access adjustment and locking systems, which provides safer and greater access to projection assemblies.

SUMMARY

The invention relates to a forward access optical framing projector assembly which is a projector assembly forward or housed behind a finished surface in which adjustments to the assembly can be made from the front end, as opposed to the sides of the projector assembly, thereby making adjustments to the projector assembly safer for a technician who may sometimes make said adjustments with a tool instead of a hand and when behind a finished surface requiring only a small opening in the finished surface.

One embodiment for a forward access optical framing projector assembly is made possible in the form of an Objective Cone Sub-Assembly, a Front Sub-Assembly, a Center Sub-Assembly, and a Back Sub-Assembly, wherein the Front Sub-Assembly is attached to the Center Sub-Assembly by fastening a light mask gate in the Front Sub-Assembly to a gate-retaining ring in the Center Sub-Assembly. In another embodiment, a locking fastener in the light mask gate is disposed parallel to the optical axis of a light source in the Back Sub-Assembly. When the locking fastener is rotated, it pushes against the gate rotation sleeve, thereby causing the Front Sub-Assembly to move away and forward of the Center Sub-Assembly. This design makes it possible for a technician to access the projector gate rotation locking fastener from the front end.

To make adjustments to the light masking shutter easier and provide long-term adjustment stability, there is an independent light masking shutter locking system comprised of a front cone flange with radial slots which is complemented by either a shutter gate with radial grooves to capture nuts from spinning, or a light masking shutter with nut retainer tab to capture nuts from spinning. Moreover, at least one light masking shutter has an adjustment tool slot so that a driver can be inserted into the slot to safely adjust the position of the light masking shutter. Both sets of embodiments provide the ability to accurately control the variable shutter adjustment requirements with adjustment movement requirements including in-and-out perpendicularly to the Optical Axis of the light source, radially around the Optical Axis, and radially around an Adjustment Contact Axis.

FIGURES

FIG. 10 depicts a schematic isometric drawing showing light masking shutters having variable shutter adjustment requirements.

Figure 43:
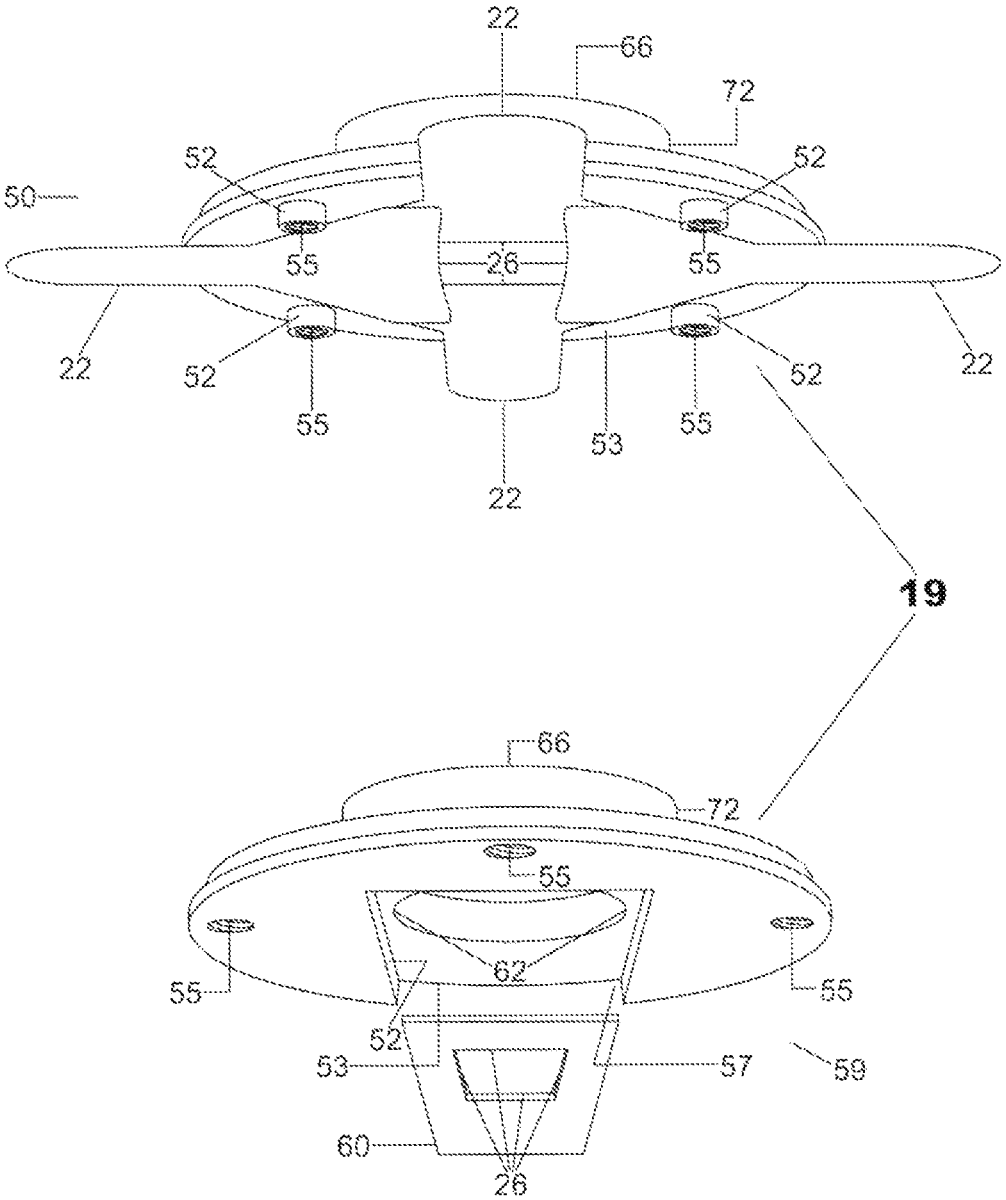

FIG. 43 isometric drawings depict a non-specific light mask gate to be either a light mask shutter gate form or a light mask plate gate form.

DESCRIPTION

Figure 1A:
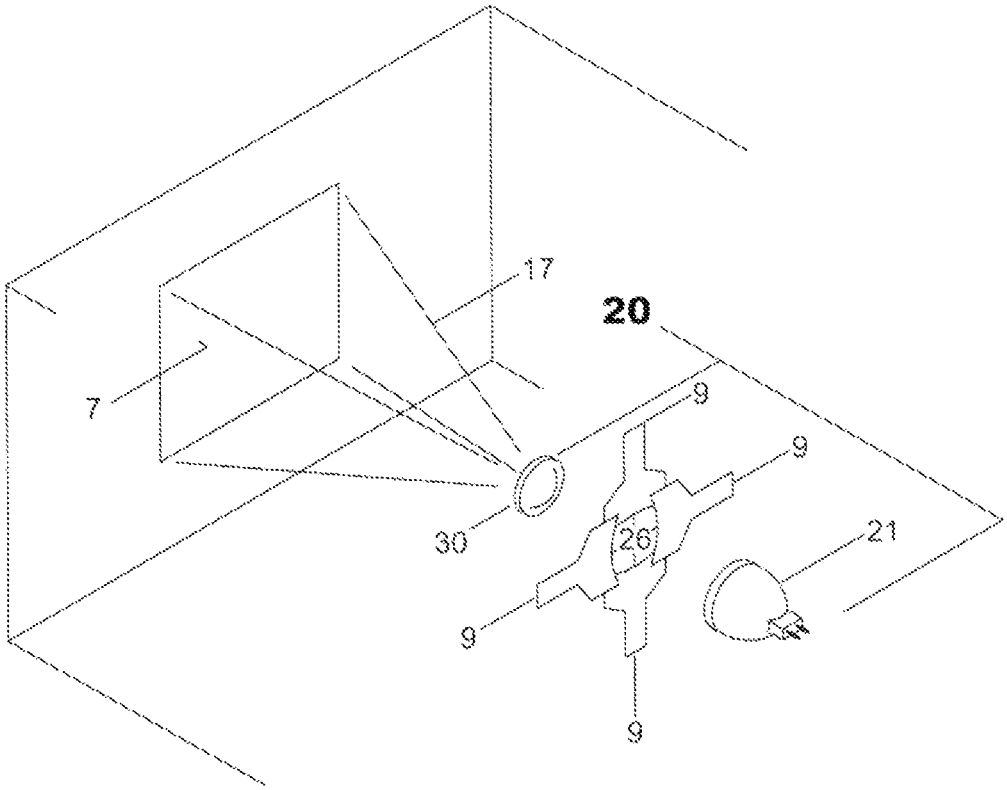
FIG. 1A depicts a schematic isometric drawing showing the three essential components required for an optical framing projector assembly and the resulting illumination zone.

FIG. 1A is a schematic isometric drawing showing the three essential components that an Optical Framing Projector Assembly (20) employs to magically stop light precisely at the edge of it's Illumination Zone (7). The Light Source (21) provide a light beam, the Light Mask (9) with a Light Masking Edge (26) illustrated in a shutter form but not limited to a shutter form provides an opening that gives shape to the light beam, and one or more Objective Focal Lenses (30) disposed within the path of the light beam serves to focus the light beam shape as well as control the diameter of the Outbound Light Beam (17) to produce a shaped Illumination Zone (7).

Figure 1B:
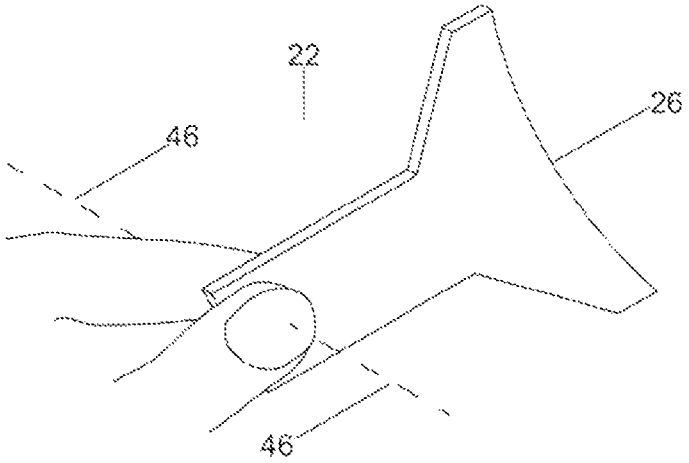
FIG. 1B depicts a perspective drawing showing a light masking shutter with an adjustment contact axis.

FIG. 1B illustrates how a Light Masking Shutter (22) is usually adjusted by a technician making contact using two fingers, example, a thumb and index finger grabbing the inner and outer flat faces at the end of a Light Masking Shutter (22). The point of contact by a technician adjusting a Light Masking Shutter (22) is here defined as an Adjustment Contact Axis (46).

Figure 1C:
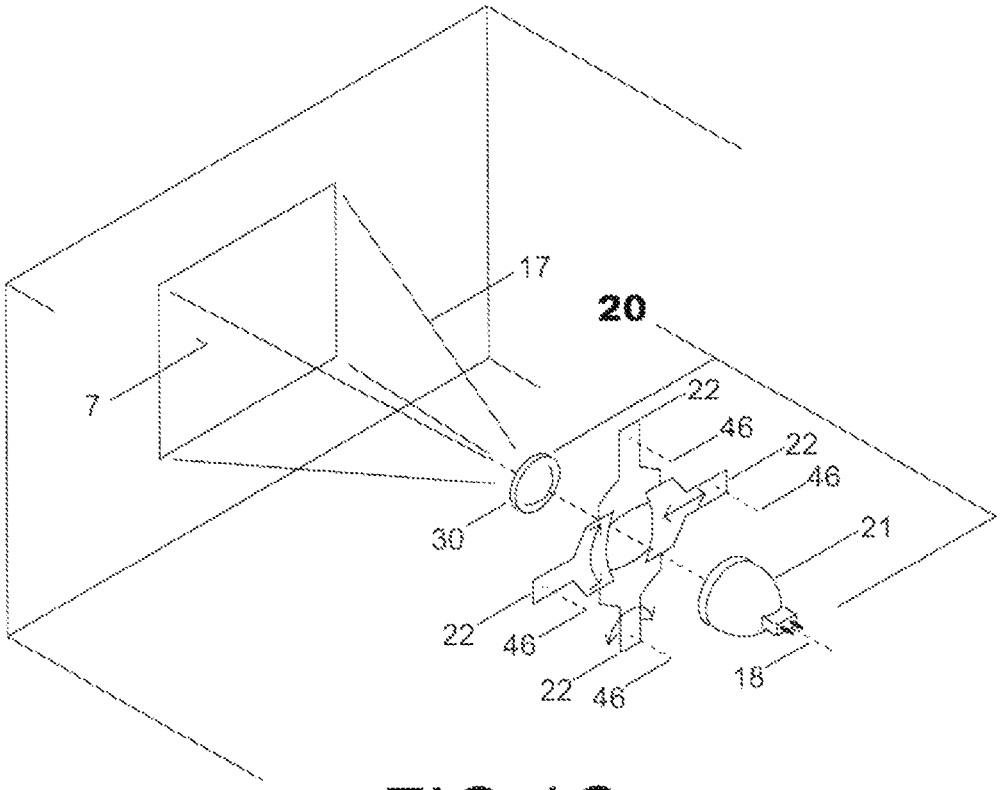

FIG. 1C is a reference drawing for Light Masking Shutters (22) illustrating variable shutter adjustment requirements. In relation to the Light Axis (18), "circumferentially" is curved radially around the Light Axis (18) like the rim of a wheel, "translationally" is linear and perpendicular in relation to the Light Axis (18) like the spokes of a wheel, "elliptically" is curved elliptically and irregularly awat from the Light Axis (18). Light Masking Shutters (22) require flexibility for movement in any direction within a light mask slot of a shutter gate not shown, with adjustment movement requirements including but not limited to, in/out perpendicular to the Light Axis (18), radially around the Light Axis (18), and radially around the Adjustment Contact Axis (46).

Figure 2:
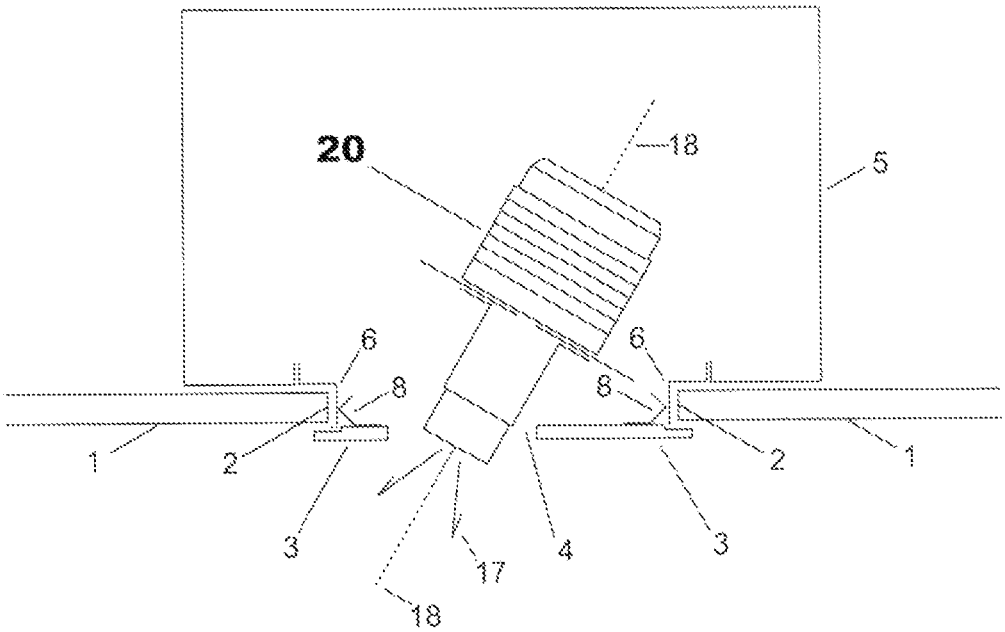
FIG. 2 depicts a section drawing showing an optical framing projector recessed within a finished surface plane of a structure.

FIG. 2 is a section drawing that illustrates a recessed Optical Framing Projector Assembly (20) installed within a Recessed Housing (5) with the fastening system for mounting the Optical Framing Projector Assembly (20) to the Recessed Housing (5) not illustrated in the drawing. The Opening In The Finished Surface Plane Of A Structure (2) is surrounded by a Trim Flange (6) and the Trim Flange (6) provides an accessible opening large enough for a contractor as he works around the projector to not get burned when manually positioning the projector, or side accessing locking fastener bodies perpendicular to the Light Axis (18). To facilitate access, a recessed Optical Framing Projector Assembly (20) will usually require a large Opening In The Finished Surface Plane Of A Structure (1) that is covered by large Trim Plate (3) held into position by Retaining Springs (8) with Trim Plate (3) including an Aperture Opening (4) for the Outbound Light Beam (17) to pass through. The large Trim Plate (3) required for a recessed Optical Framing Projector Assembly (20) is non-appealing to architects often resulting in Optical Framing Projector Assembly (20) to not be specified by architects due to the non-appealing large Trim Plate (3) size.

Figure 3:
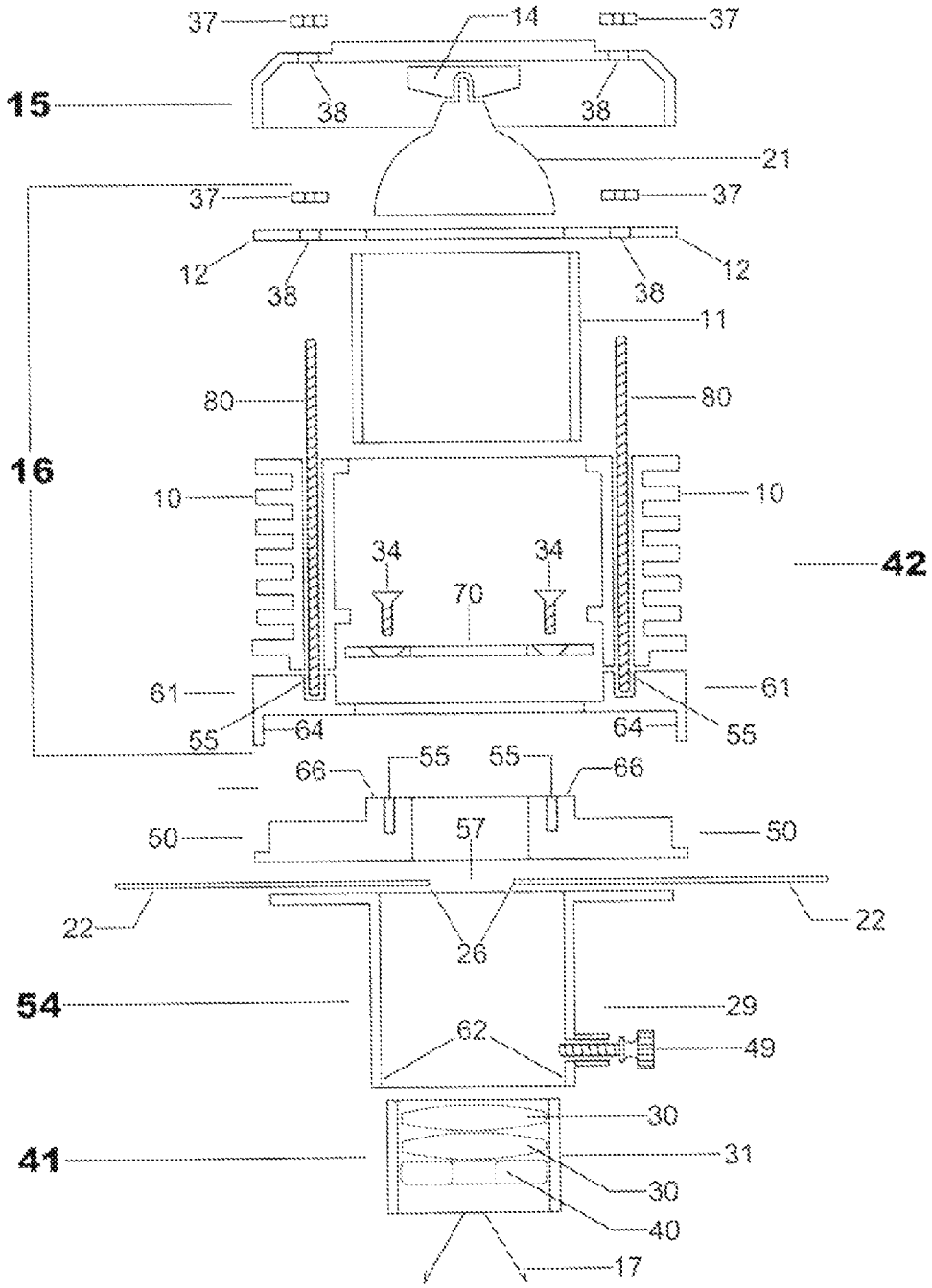
FIG. 3 depicts a section drawing showing general components for a forward access optical framing projector assembly.
Figure 4:
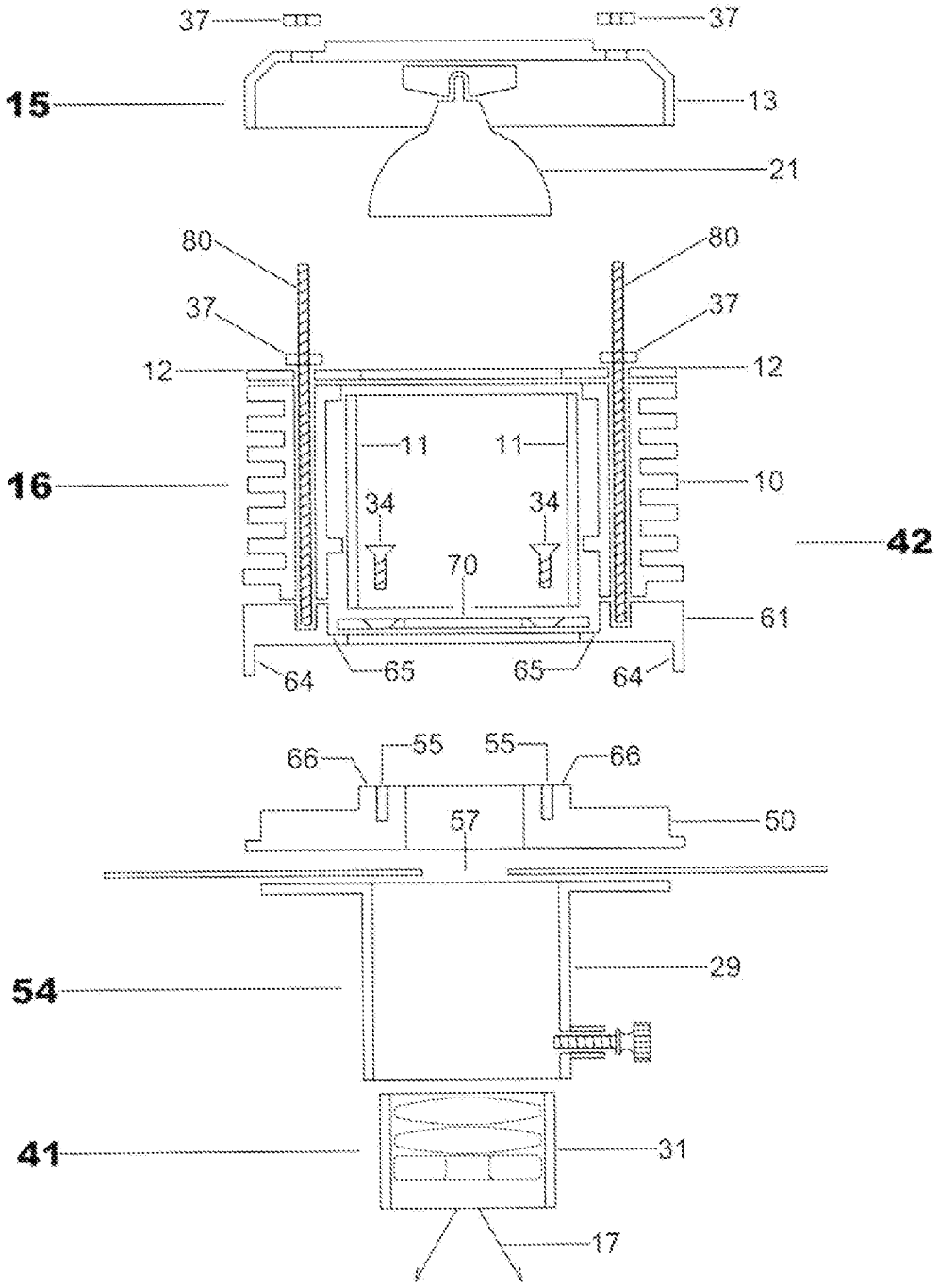
FIG. 4 depicts a section drawing showing general sub-assemblies for a forward access optical framing projector assembly.

FIGS. 3, 4 illustrate some invention components that include embodiment features for gate rotation with those components including, the Light Mask Shutter Gate (50), Gate Rotation Sleeve (61), and Gate Retaining Ring (70).

FIGS. 3, 4 are section drawings illustrating sub-assemblies as well as a portion of the components and or features with some found in an embodiment for the invention's Forward Access Optical Framing Projector Assembly (42). FIG. 3 illustrates sub-assemblies nearly assembled. FIG. 4 illustrates the sub-assemblies assembled.

In FIG. 3, Objective Cone Sub-Assembly (41) includes the following components: Objective Focal Cone (31) with Objective Focal Lenses (30) installed within Objective Focal Cone (31) and retained inside by Spring Clip (40). Objective Cone Sub-Assembly (41) joins into the Front Sub-Assembly (54) through Inner Opening (62) of the Front Cone (29) and is retained by a Thumb Screw (49).

In FIG. 3, the Front Sub-Assembly (54) includes two main components, a Front Cone (29) and Light Mask Shutter Gate (50). The Front Cone (29) joins with the Light Mask Shutter Gate (50) using methods described in a later embodiment. FIGS. 3,4 illustrations for Light Mask Shutter Gate (50) include only a portion of the features and components with the balance of features and components to be described in a later embodiment. In FIG. 3, the Light Mask Shutter Gate (50) includes the following components and or features: Light Masking Shutters (22) having a Light Masking Edge (26), with Light Masking Shutters (22) positioned within a Light Mask Slot (57), an Upper Rim Face (66) that includes Threaded Holes (55). The Front Sub-Assembly (54) aligns into the Center Sub-Assembly (16) through Flange A (64) of the Gate Rotation Sleeve (61). In FIG. 3 and FIG. 4, the Light Mask Shutter Gate (50) Upper Rim Face (66) Threaded Holes (55) receive Screws (34) found in the Center Sub-Assembly (16) that will retain Center Sub-Assembly (16) Gate Retaining Ring (70) against the Upper Rim Face (66) of the Light Mask Shutter Gate (50) to join Front Sub-Assembly (54) with the Center Sub-Assembly (16) using Flange B (65).

FIG. 3 illustrates the nearly assembled Center Sub-Assembly (16) while FIG. 4 illustrates the Center Sub-Assembly (16) fully assembled. Center Sub-Assembly (16) includes five main components, a Gate Rotation Sleeve (61), Lamp Housing (10), Gate Retaining Ring (70), Lamp Alignment Tube (11), and Retaining Ring (12). Threaded Rods (80) fasten into Threaded Holes (55) of the Gate Rotation Sleeve (61). Lamp Alignment Tube (11) fits into the Inner Opening (62) of the Lamp Housing (10). Retaining Ring (12) with Clearance Holes (38) slides down through Threaded Rods (80). Nuts (37) fasten to Threaded Rods (80) and compress the Retaining Ring (12) to unite the Center Sub-Assembly (16).

FIG. 3 illustrates the Back Sub-Assembly (15) to include three main components, a Back Cap (13), Lamp Holder (14), and Light Source (21). The Lamp Holder (14) is attached to the Back Cap (13) and a Light Source (21) engages into the Lamp Holder (14). Back Cap (13) includes Clearance Holes (38) for the Back Cap (13) to slide down through Threaded Rods (80). Nuts (37) fasten onto Threaded Rods (80) and compress the Back Cap (13) against the Retaining Ring (12) at the top of Center Sub-Assembly (16).

Figure 5:
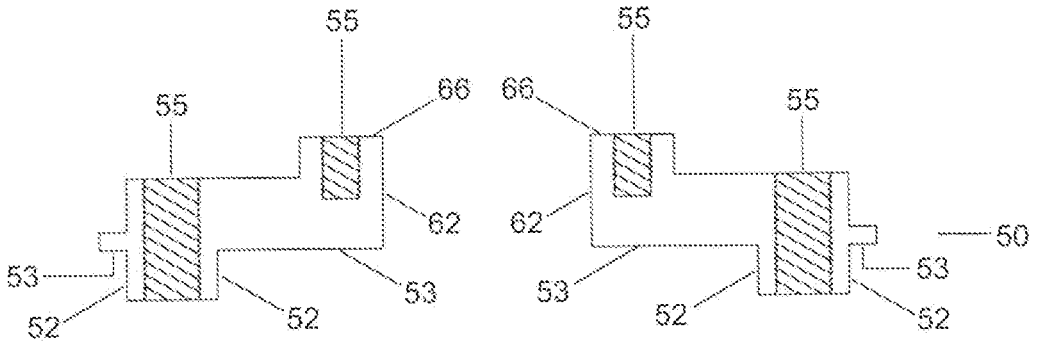
FIG. 5 depicts a section drawing for a shutter gate in a forward access optical framing projector assembly.

FIG. 5 is a section drawing illustrating a portion of the features for Light Mask Shutter Gate (50) found in an embodiment for the invention's Forward Access Optical Framing Projector Assembly (42). FIG. 5 section view is rotated 90° off of the light axis compared to the Light Mask Shutter Gate (50) view illustrated in FIGS. 3, 4. FIG. 5 illustrates the Light Mask Shutter Gate (50) to include the following features, Standoffs (52) extending beyond Plane A (53), Threaded Holes (55) running clear through Standoffs (52), an Inner Opening (62) for light path to pass through, an Upper Rim Face (66) that includes Threaded Holes (55).

Figure 6:
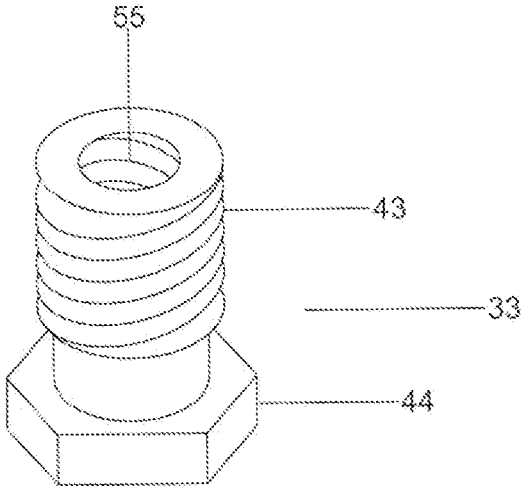
FIG. 6 depicts an isometric drawing for a hex screw nut retainer body that can be utilized in a forward access optical framing projector assembly.

FIG. 6 is a perspective drawing illustrating a Hex Screw Nut Retainer Body (33) found in an embodiment for the invention's Forward Access Optical Framing Projector Assembly (42) that includes a Hex Head (44), outer Male Thread (43), and interior Threaded Hole (55) running through the entire length.

Figure 7:
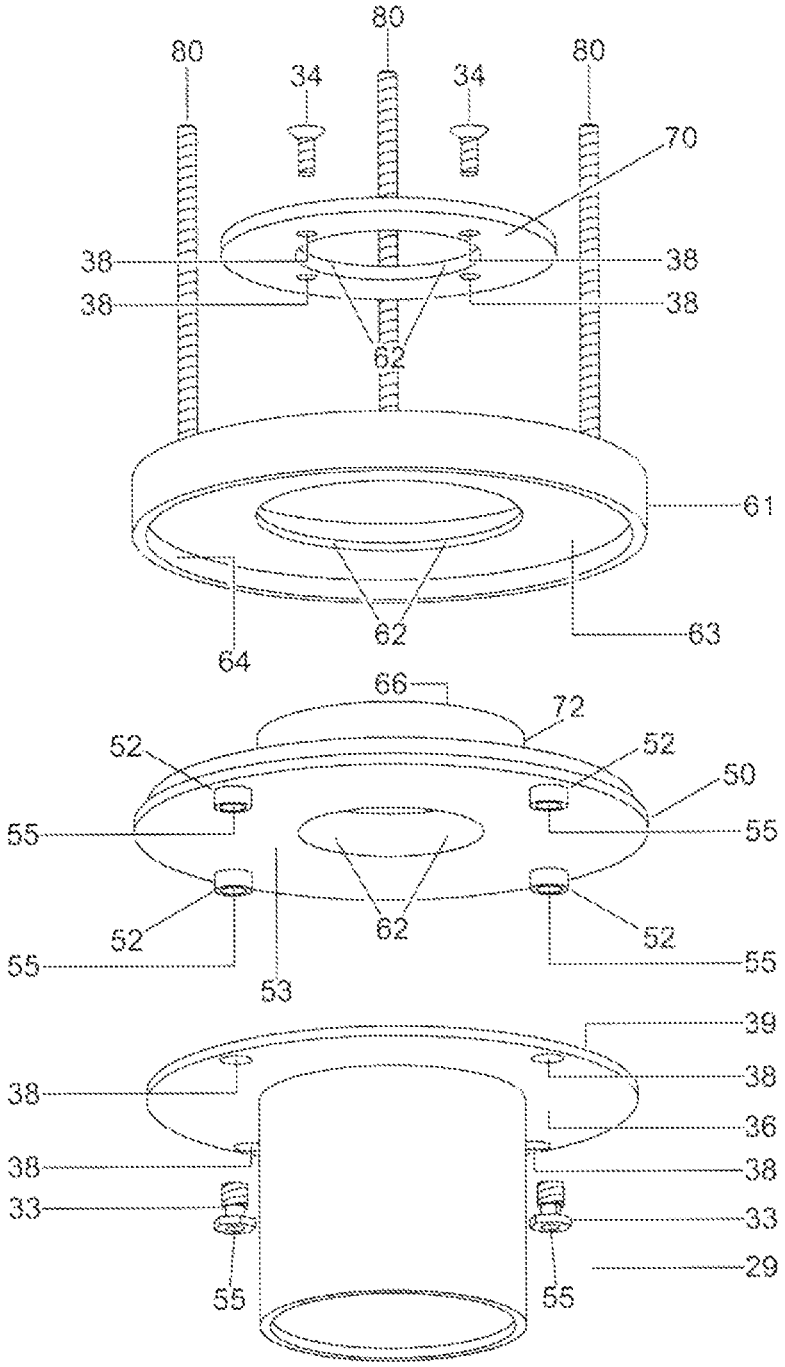
FIG. 7 depicts an isometric drawing showing interaction between a front cone and gate components before assembly when using a hex screw nut retainer body.

FIG. 7 is an isometric drawing illustrating components and or features with some found in an embodiment for the invention's Forward Access Optical Framing Projector Assembly (42) and furthermore FIG. 7 describes interaction between the Front Cone (29), Light Mask Shutter Gate (50), Gate Rotation Sleeve (61), and Gate Retaining Ring (70). The Front Cone (29) includes a Front Cone Flange (36) having Clearance Holes (38) for the Male Threaded (43) portion of Hex Screw Nut Retainer Body (33) to pass through. The Light Mask Shutter Gate (50) includes, Standoffs (52) extending beyond Plane A (53), Threaded Holes (55) running clear through Standoffs (52), an Inner Opening (62) for a light path to pass through, an Upper Rim (72) having an Upper Rim Face (66) including Threaded Holes (55) not shown. The Gate Rotation Sleeve (61) includes, Flange A (64), an Outside Face Of Gate Rotation Sleeve (63), an Inner Opening (62) for light path to pass through, and Threaded Rods (80) fastened to the ring. The Gate Retaining Ring (70) includes an Inner Opening (62) for light path to pass through and Clearance Holes (38) for Screws (34) to pass through.

Figure 8:
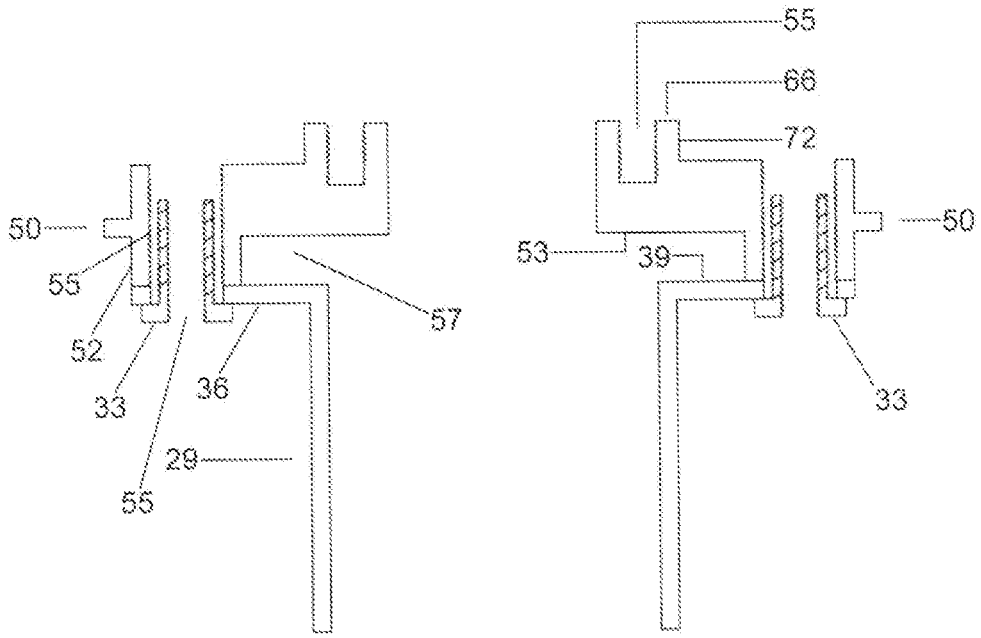
FIG. 8 depicts a section drawing for joining a front cone to a shutter gate using a hex screw nut retainer body.

FIG. 8 is a section drawing including some embodiment components, fasteners, and or features for a Front Cone (29) joined with a Light Mask Shutter Gate (50) representing a portion of the features for Front Sub-Assembly (54). The Front Cone Flange (36) Clearance Holes (38) shown in FIG. 7 provide a passage for Hex Screw Nut Retainer Bodies (33) to pass through and Hex Screw Nut Retainer Bodies (33) are fastened into Threaded Holes (55) of Standoffs (52) shown in FIG. 8, with Standoffs (52) extending beyond Plane A (53) and joining by compression down against Plane B (39) of the Front Cone Flange (36) forming a Light Mask Slot (57).

Forward Access Gate Rotation System

The forward access Gate Rotation Systems (68) provides the installation technician ability to rotate the Front Sub-Assembly (54) together with the Objective Cone Sub-Assembly (41) from the front of the projector with some of the features also being embodiments that are foundations for the Forward Access Gate Rotation Locking System (74) described later.

Figure 9:
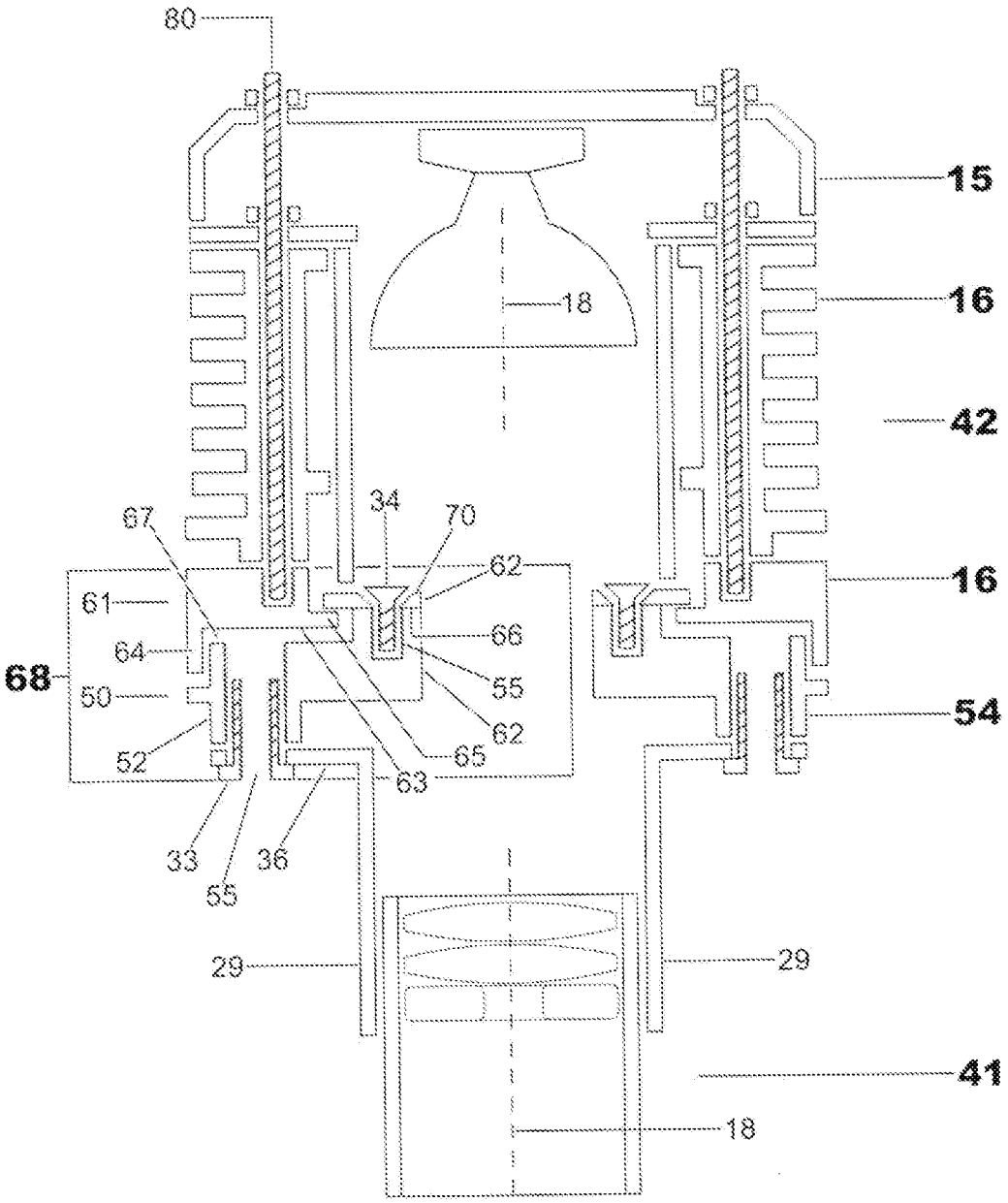
FIG. 9 depicts a section drawing for a forward access gate rotation system.
Figure 10A:
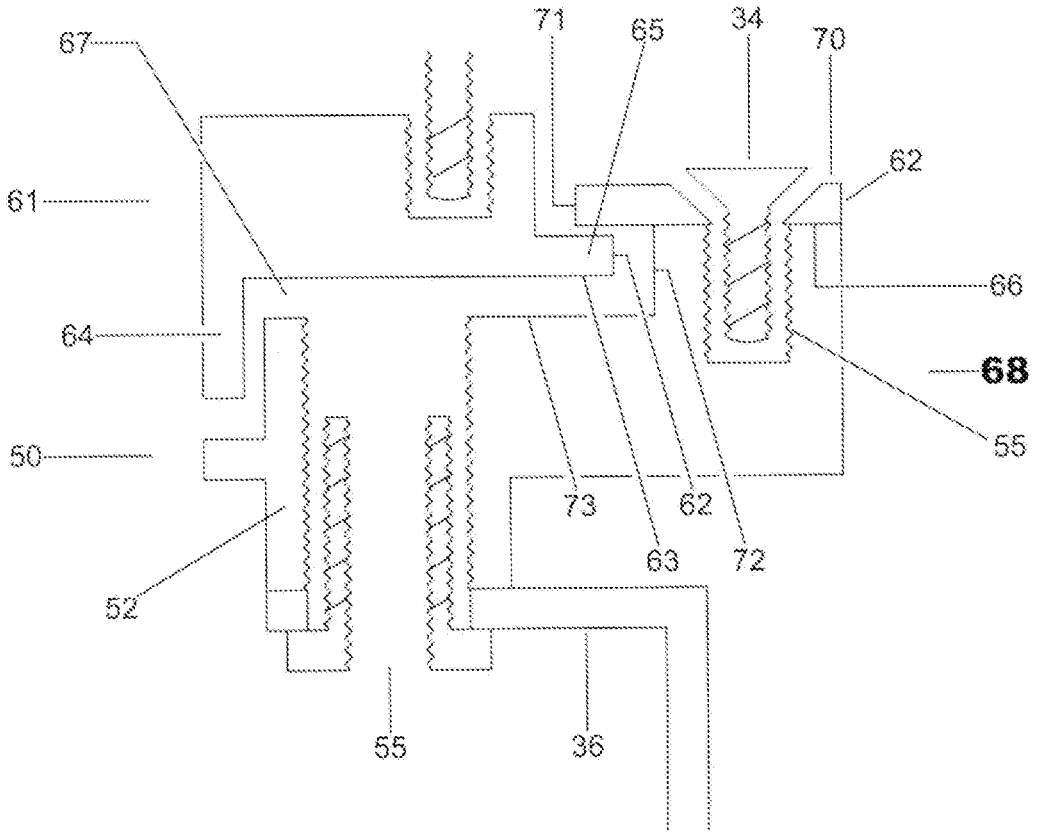
FIG. 10A depicts an enlarged section drawing for a forward access gate rotation system that utilizes an outside flange to center a shutter gate.
Figure 10B:
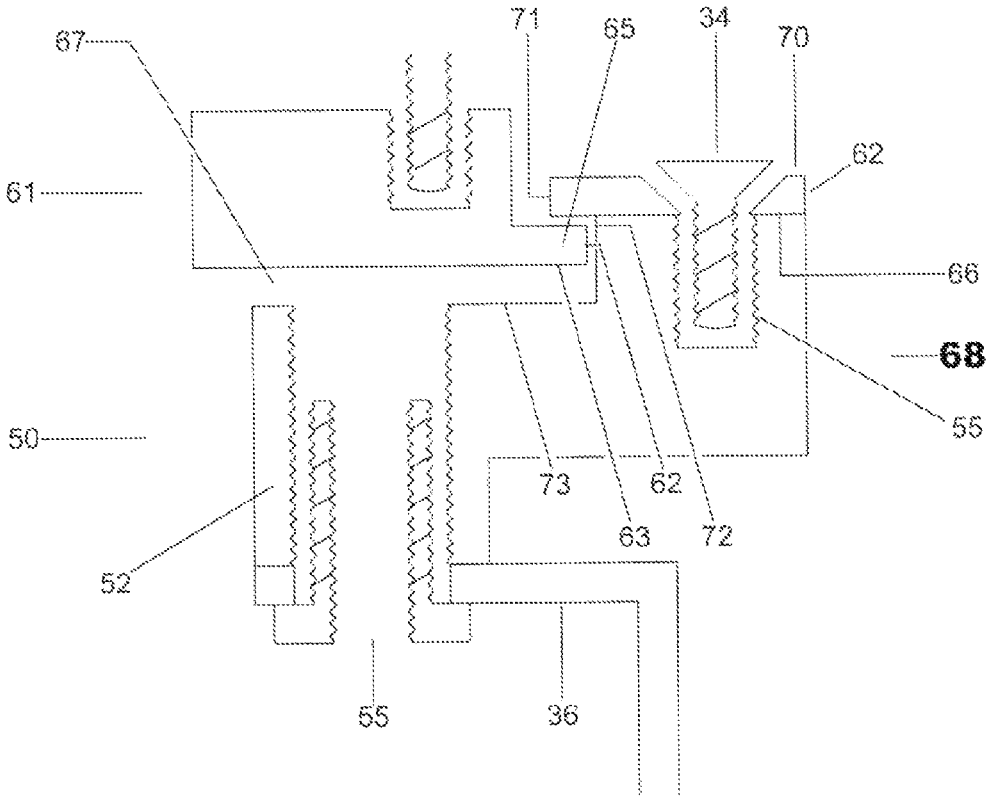
FIG. 10B depicts an enlarged section drawing for a forward access gate rotation system that utilizes an alternate inner flange to center a shutter gate.

FIGS. 9, 10A, 10B are section drawings illustrating components and or features with some found in an embodiment for the invention's Forward Access Optical Framing Projector Assembly (42) and including a portion of the components and or features found in the Gate Rotation Locking System (74) invention described later. Former embodiments combined with FIGS. 9, 10A, 10B embodiments illustrate systems, fasteners, and features after joining the Front Sub-Assembly (54) with the Center Sub-Assembly (16). Furthermore, former embodiments combined with FIGS. 9, 10A, 10B embodiments illustrate a portion of the components, fasteners, and features for a Gate Rotation System (68) detailed in FIGS. 10A, 10B, providing independent rotation for the Front Sub-Assembly (54) combined with the Objective Cone Sub-Assembly (41) around the Light Access (18) while maintaining the Center Sub-Assembly (16) combined with the Back Sub-Assembly (15) independently stationary from the two front sub-assemblies.

FIG. 10A is an enlarged view of the Gate Rotation System (68) embodiment called out by a rectangle in FIG. 9. In FIG. 9, the Center Sub-Assembly (16) is joined to the Front Sub-Assembly (54) using a Gate Retaining Ring (70). FIG. 10A illustrates in detail the Gate Retaining Ring (70) being fastened against the Upper Rim Face (66) of the Light Mask Shutter Gate (50) using Screws (34) threaded into the Upper Rim Face (66) Threaded Holes (55). The Gate Rotation Sleeve (61) Flange B (65) has an Inner Opening (62) that is smaller than the Outside Diameter (71) of the Gate Retaining Ring (70) for Flange B (65) to internally join the Light Mask Shutter Gate (50) with the Gate Rotation Sleeve (61) after installing the Gate Retaining Ring (70). The height of Flange B (65) is less than the height of the Upper Rim (72) causing a Gap (67) between the Outside Face Of Gate Rotation Sleeve (63) and the Inside Face Of Gate (73) with Light Mask Shutter Gate (50) designed to independently float within Flange A (64) of the Gate Rotation Sleeve (61) near centered to the Light Axis (18) with said floatation being both parallel to the Light Axis (18) and rotationally around the Light Axis (18).

FIG. 10B is an enlarged view for an alternate construction to the Gate Rotation System (68) embodiment illustrated in FIG. 10A. In FIG. 10B, the Light Mask Shutter Gate (50) is centered to the Light Axis (18) using the Gate Rotation Sleeve (61) Inner Opening (62) of Flange B (65).

FIG. 10B illustrates in detail the Gate Retaining Ring (70) being fastened against the Upper Rim Face (66) of the Light Mask Shutter Gate (50) using Screw (34) threaded into the Upper Rim Face (66) Threaded Hole (55). The Gate Rotation Sleeve (61) Flange B (65) has an Inner Opening (62) that is slightly smaller than the Outside Diameter (71) of the Gate Retaining Ring (70) for Flange B (65) to internally join the Light Mask Shutter Gate (50) with the Gate Rotation Sleeve (61) after installing the Gate Retaining Ring (70). The height of Flange B (65) is less than the height of the Upper Rim (72) causing a Gap (67) between the Outside Face Of Gate Rotation Sleeve (63) and the Inside Face Of Gate (73) with Light Mask Shutter Gate (50) Upper Rim (72) outside diameter designed to closely fit within the Inner Opening (62) of Flange B (65) for Light Mask Shutter Gate (50) to independently float within Flange B (65) of the Gate Rotation Sleeve (61) near centered to the Light Axis (18) with said floatation being both parallel to the Light Axis (18) and rotationally around the Light Axis (18).

FIGS. 9, 10A, 10B embodiments are by way of example for a Gate Rotation System (68) using the components and or features shown and not by way of limiting to use all the components and or features shown. At least four optional embodiments, not illustrated, include, Hex Screw Nut Retainer Body (33) replaced by a Screw (34), Front Sub-Assembly (54) cast and made into a single component, Gate Retaining Ring (70) Inner Opening (62) press fit around the outside of Upper Rim (72) without using Screw (34), Gate Retaining Ring (70) Inner Opening (62) threaded as a nut to screw onto a threaded Upper Rim (72) without using Screw (34).

Forward Access Gate Rotation Locking System

The Forward Access Gate Rotation Locking System (74) is used for both recessed and surface mounted Forward Access Optical Framing Projector Assemblies (42). It implements at least one forward access gate locking fastener with the forward access gate locking fastener body orientated near parallel to the light axis with access to drive the forward access gate locking fastener from the front of the projector. On a surface mounted projector, the forward access gate locking fastener-orientated near parallel to the light axis provides a cleaner line to the projector side profile.

Figure 11:
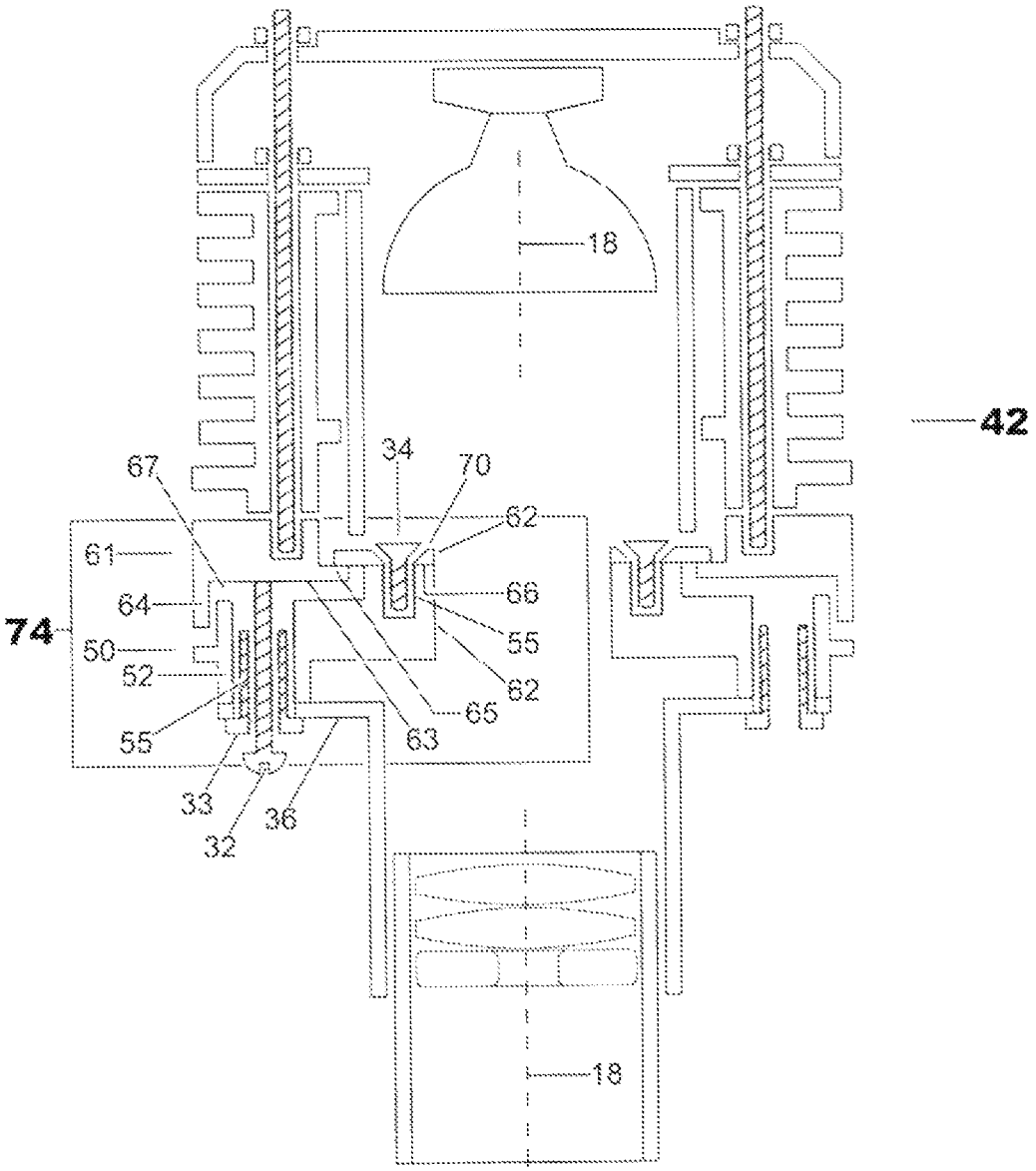
FIG. 11 depicts a section drawing for a forward access gate rotation locking system.
Figure 12A:
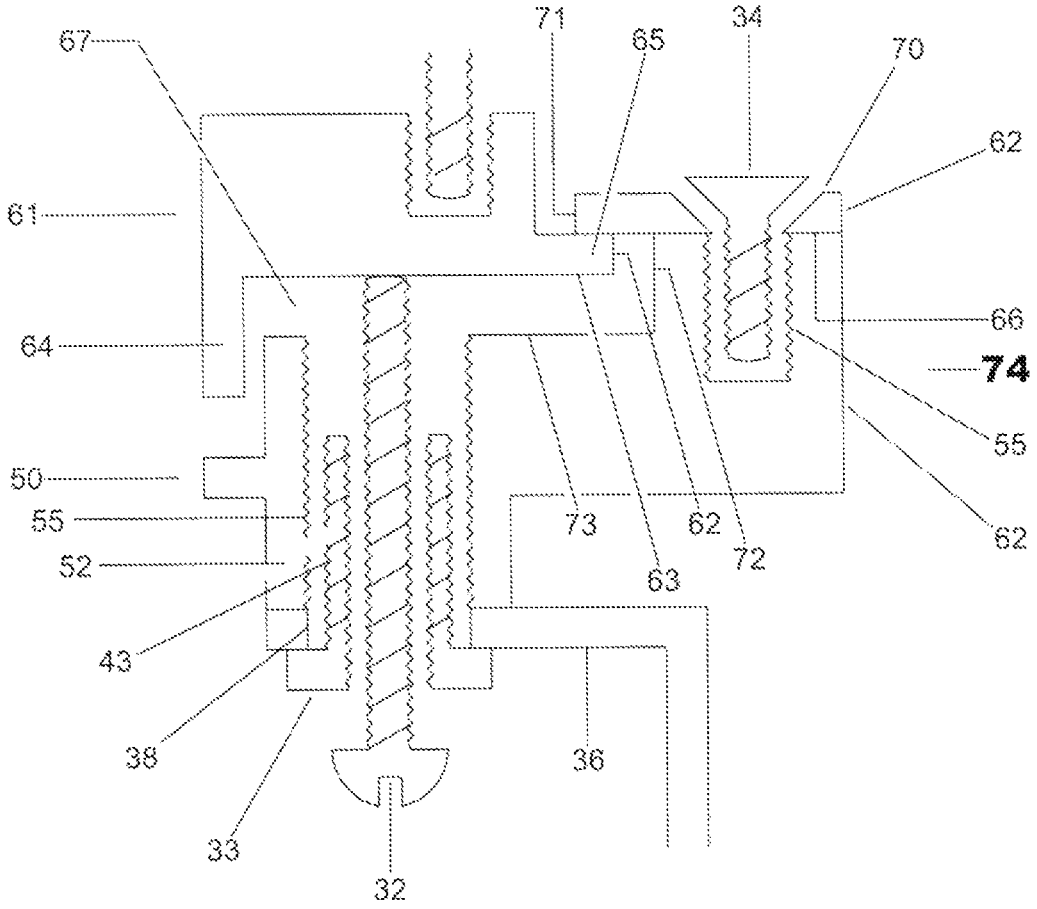
FIG. 12A depicts an enlarged section drawing for a forward access gate rotation locking system that utilizes a hex screw nut as the retainer body for a locking fastener in the rotation locking system.
Figure 12B:
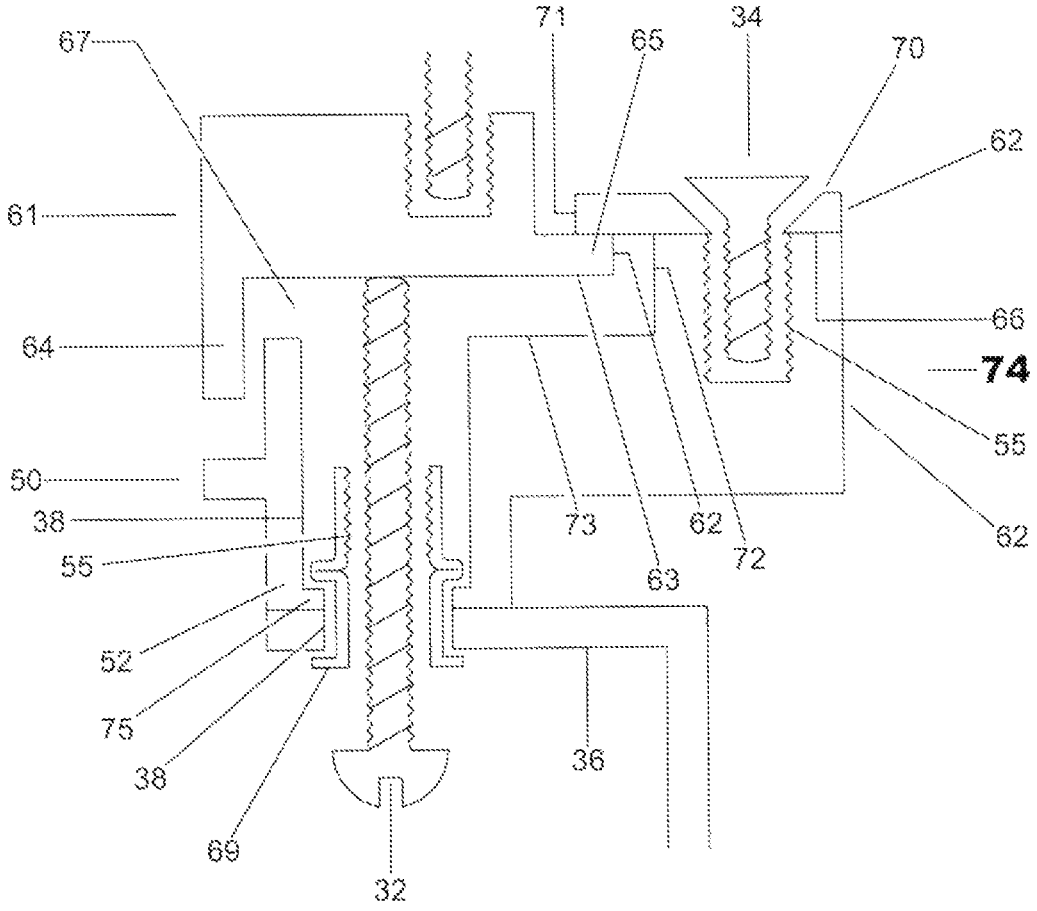
FIG. 12B depicts an enlarged section drawing for a forward access gate rotation locking system that utilizes a Rivet Nut as the retainer body for a locking fastener in the rotation locking system.

FIGS. 11, 12A, 12B are section drawings illustrating portions of an assembled Forward Access Optical Framing Projector Assembly (42) including a Forward Access Gate Rotation Locking System (74). Former embodiments combined with FIGS. 11, 12A, 12B embodiments illustrate systems, fasteners, and features applicable towards a pressure lock technique for a Forward Access Gate Rotation Locking System (74).

FIG. 12A is an enlarged view of the Forward Access Gate Rotation Locking System (74) called out by a rectangle in FIG. 11. FIG. 12A illustrates in detail a Forward Access Gate Rotation Locking System (74) embodiment to include a Locking Fastener (32) in addition to the components and features found in FIGS. 9, 10. Locking Fastener (32) is threaded into the Hex Screw Nut Retainer Body (33) having an interior Threaded Hole (55) with the Locking Fastener (32) end making contact with the Outside Face Of Gate Rotation Sleeve (63) that provides pressure against the Outside Face Of Gate Rotation Sleeve (63) pushing the Inside Face Of Shutter Gate (73) away to cause an increased Gap (67) between the Outside Face Of Gate Rotation Sleeve (63) and the Inside Face Of Gate (73) and locking by pressure the Gate Retaining Ring (70) against Flange B (65) to prevent Light Mask Shutter Gate (50) rotation after adjustment.

FIG. 12B is an enlarged view for an alternate construction to the Forward Access Gate Rotation Locking System (74) embodiment illustrated in FIG. 12A. In FIG. 12B, the Hex Screw Nut Retainer Body (33) is replaced by a Rivet Nut Retainer Body (69) with a portion of Rivet Nut Retainer Body (69) inserted within the interior of a Standoff (52) having a Clearance Hole (38) and a Flange C (75) for the Rivet Nut Retainer Body (69) to expand and clinch onto Flange C (75) after using a Rivet Nut Retainer Body (69) installation tool. Locking Fastener (32) is threaded into the Rivet Nut Retainer Body (69) having an interior Threaded Hole (55) with the Locking Fastener (32) end making contact with the Outside Face Of Gate Rotation Sleeve (63) that provides pressure against the Outside Face Of Gate Rotation Sleeve (63) pushing the Inside Face Of Shutter Gate (73) away to cause an increased Gap (67) between the Outside Face Of Gate Rotation Sleeve (63) and the Inside Face Of Gate (73) and locking by pressure the Gate Retaining Ring (70) against Flange B (65) to prevent Light Mask Shutter Gate (50) rotation after adjustment.

FIGS. 11, 12A, 12B embodiments are by way of example for a Forward Access Gate Rotation Locking System (74) using the components and or features shown and not by way of limiting to use all the components and or features shown. At least two optional embodiments, not illustrated, include, Hex Screw Nut Retainer Body (33) and or Rivet Nut Retainer Body (69) not retaining the Front Cone Flange (36) to the Light Mask Shutter Gate (50), and another embodiment being Locking Fastener (32) integrated into a cam type system having a retainer body to guide Locking Fastener (32) without the use of male threads as the screw illustrated and with the cam system retainer body attached to either the Front Cone Flange (36), the Light Mask Shutter Gate (50), or both.

Figure 13:
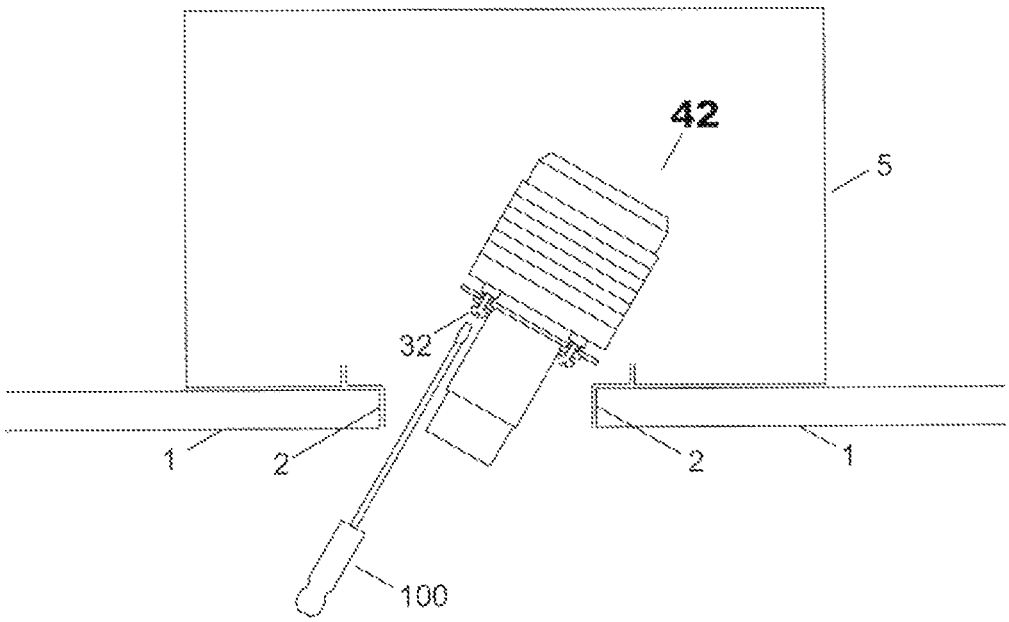
FIG. 13 depicts a section drawing showing a forward access gate rotation locking System utilized on a forward access optical framing projector assembly recessed within the finished surface plane of a structure.

FIG. 13 is a sectional drawing illustrating a recessed Forward Access Optical Framing Projector Assembly (42) installed within a Recessed Housing (5) with Driver (100) nearly ready to drive the Locking Fastener (32) to either lock or unlock a Forward Access Gate Rotation Locking System (74) from the front side of a projector, with the Forward Access Gate Rotation Locking System (74) providing a method to reduce the size of Opening In The Finished Surface Plane Of A Structure (2).

Figure 14:
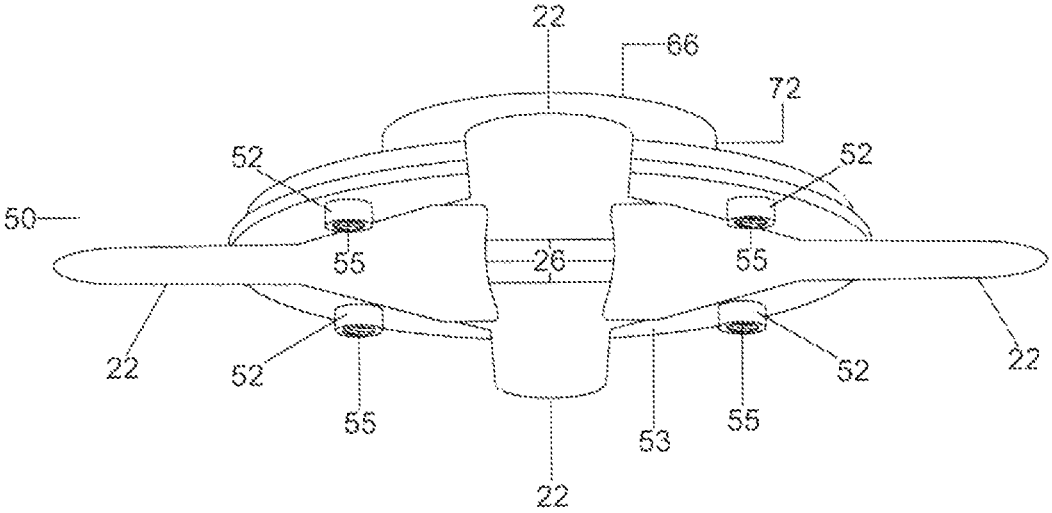
FIG. 14 depicts an isometric drawing showing a light mask form being shutters that are positioned within a shutter gate.

FIG. 14 is an isometric drawing illustrating a Light Mask Shutter Gate (50) form having Standoffs (52) extending beyond Plane A (53) with Light Masking Shutters (22) positioned between Standoffs (52), and if the Light Mask Shutter Gate (50) with Light Masking Shutters (22) features of FIG. 14 were combined with a Front Cone Flange (36) having Plane B (39) as shown in FIG. 8, would form a Light Mask Slot (57) in combination with Light Masking Shutters (22) within a Light Mask Slot (57).

Figure 15:
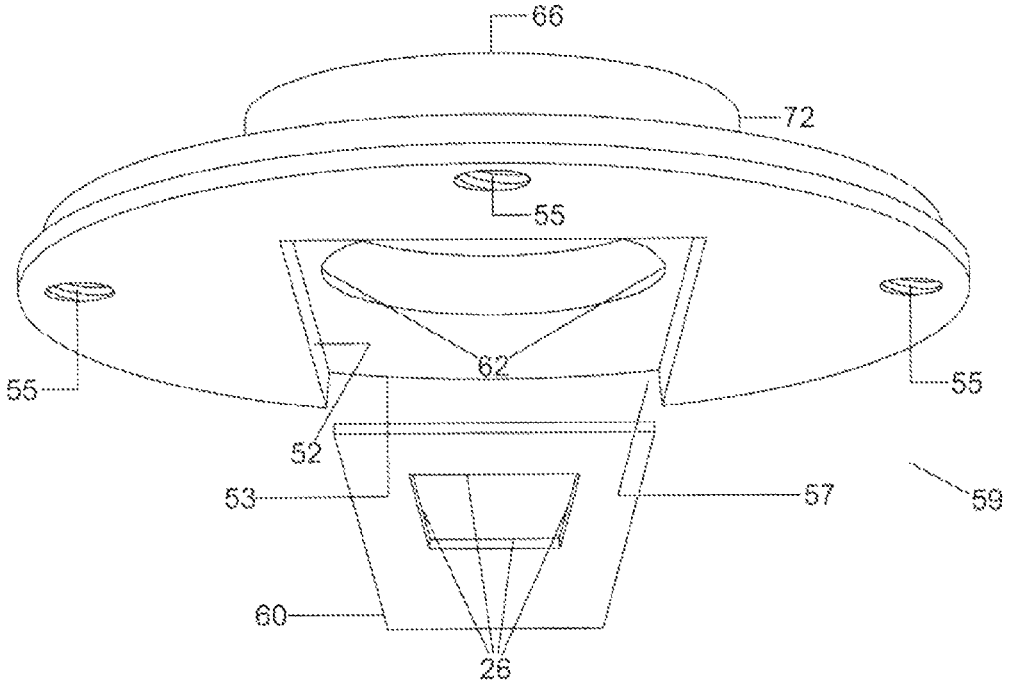
FIG. 15 depicts an isometric drawing showing a light mask form being a light masking plate for use in a light mask plate gate with the gate design being an alternate embodiment for the forward access gate rotation and forward access gate rotation locking systems.

FIG. 15 is an isometric drawing illustrating a Light Mask Plate Gate (59) form that includes, a Standoff (52) extending beyond Plane A (53), Threaded Holes (55) running clear through the Standoff (52), an Inner Opening (62) to allow light to pass through, an Upper Rim (72) having an Upper Rim Face (66) including Threaded Holes (55) not shown, and a Light Mask Slot (57) formed by Standoff (52) to receive a Light Masking Plate (60). Light Masking Plate (60) has Light Masking Edges (26) to shape light that is focused by an Objective Focal Lens (30) not illustrated.

In this application, specific light mask gate forms may be specified. However, whenever specificity is not required and an embodiment applies to either a Light Mask Shutter Gate (50) form or a Light Mask Plate Gate (59) form then the non-specific Light Mask Gate (19) term as illustrated in FIG. 43 may be used. The Light Mask Plate Gate (59) shown in FIGS. 15, 43 differs from a Light Mask Shutter Gate (50) shown in FIGS. 7, 43 by Standoff (52) design. In FIG. 15, Standoff (52) design forms an obvious Light Mask Slot (57). In FIG. 7, Standoff (52) design does not form an obvious Light Mask Slot (57) until a Front Cone Flange (36) is joined together with the Light Mask Shutter Gate (50) as illustrated in FIG. 8. Light Mask Plate Gate (59) is designed to receive a Light Masking Plate (60) while a Light Mask Shutter Gate (50) is designed to receive a Light Masking Shutter (22). Outside of Standoff (52) design forming an obvious Light Mask Slot (57) in FIG. (15) for the type of light mask to be implemented, a Light Mask Plate Gate (59) carries the same described embodiments as a Light Mask Shutter Gate (50) including but not limited to the Gate Rotation System (68) and the Forward Access Gate Rotation Locking System (74) described in former embodiments.

Figure 16:
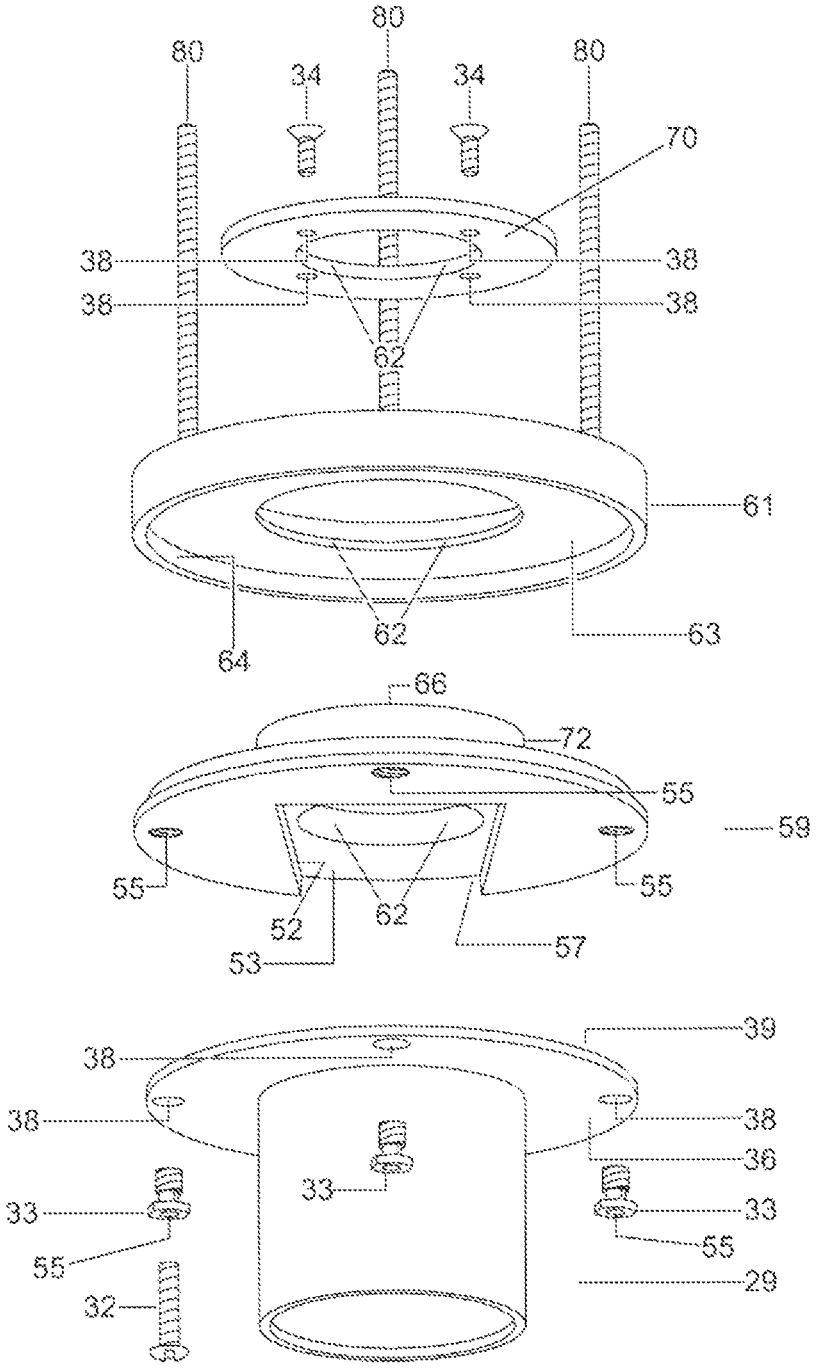
FIG. 16 depicts an isometric drawing showing interaction between a front cone and gate components before assembly when the gate assembly includes a light mask plate gate as an alternate embodiment for the forward access gate rotation and forward access gate rotation locking systems.

FIG. 16 is an isometric drawing illustrating all of the same features as those described in FIG. 7 with the only difference being FIG. 16 includes a Light Mask Plate Gate (59) while FIG. 7 includes a Light Mask Shutter Gate (50).

FIG. 16 is an isometric drawing illustrating a portion of the features and interaction between the Front Cone (29), Light Mask Plate Gate (59), Gate Rotation Sleeve (61), and Gate Retaining Ring (70). The Front Cone (29) includes a Front Cone Flange (36) having Clearance Holes (38) for the Male Threaded (43) portion of Hex Screw Nuts Retainer Body (33) to pass through. The Light Mask Plate Gate (59) includes, a Standoff (52) extending beyond Plane A (53), Threaded Holes (55) running clear through Standoff (52), an Inner Opening (62) for a light path to pass through, an Upper Rim (72) having an Upper Rim Face (66) including Threaded Holes (55) not shown. The Gate Rotation Sleeve (61) includes, Flange A (64), an Outside Face Of Gate Rotation Sleeve (63), an Inner Opening (62) for light path to pass through, and Threaded Rods (80) fastened to the ring. The Gate Retaining Ring (70) includes an Inner Opening (62) for light path to pass through, and Clearance Holes (38) for Screws (34) to pass through.

Since FIG. 16 is essentially the same as FIG. 7, the features and embodiments described in FIG. 8 also apply to FIG. 16 with the only difference being FIG. 16 includes a Light Mask Plate Gate (59) while FIG. 7 includes a Light Mask Shutter Gate (50) and therefore the features are applicable to the non-specific Light Mask Gate (19).

Since FIG. 16 is essentially the same as FIG. 7 having the same features and embodiments described in FIG. 8, then features and embodiments described in FIGS. 9, 10, 11, 12 including, a Gate Rotation System (68) and a Forward Access Gate Rotation Locking System (74) are also embodiments that apply to a Light Mask Plate Gate (59) illustrated in FIG. 16 and therefore the features and embodiments are applicable to the non-specific Light Mask Gate (19).

Forward Access Independent Light Mask Shutter Locking System

The Forward Access Independent Light Mask Shutter Locking System (45) is a method to independently lock Light Masking Shutters (22) for ease of adjustment, and is advantageous for both recessed and surface mounted Forward Access Optical Framing Projector Assemblies (42).

Three sets of embodiments for the Forward Access Independent Light Mask Shutter Locking System (45) are disclosed.

FIGS. 17, 18, 19, 20, 21 describe the first set of embodiments for a Forward Access Independent Light Mask Shutter Locking System (45) including Light Masking Shutters (22) positioned in a Light Mask Slot (57) of a Light Mask Shutter Gate (50) having Radial Grooves (51) to retain Nuts (37) from spinning.

FIGS. 18, 22, 23, 24, 25 describe the second set of embodiments for a Forward Access Independent Light Mask Shutter Locking System (45) including combining Light Masking Shutters (22) with a Shutter Separator Plate (56) positioned in a Light Mask Slot (57) of a Light Mask Shutter Gate (50) having Radial Grooves (51) to retain Nuts (37) from spinning.

FIGS. 26, 27, 28, 29, 30 describe the third set of embodiments for a Forward Access Independent Light Mask Shutter Locking System (45) including Light Masking Shutters (22) having Nut Retainer Tabs (47) to retain Nuts (37) from spinning with Light Masking Shutters (22) positioned in a Light Mask Slot (57) of a Light Mask Shutter Gate (50).

The three sets of embodiments implement a forward access fastener running parallel to the Light Axis (18) with access to drive the Forward Access Independent Light Mask Shutter Locking System (45) fasteners from the front of the projector. The three sets of embodiments demonstrate how one or more Light Masking Shutters (22) can be driven to a locked position without locking movement on another Light Masking Shutter (22) for ease of adjustment. The three sets of embodiments provide a means to a method for one or more locked Light Masking Shutters (22) to maintain their position without being moved by an unlocked Light Masking Shutter (22) during the un-locked Light Masking Shutters (22) independent shutter adjustment. Depending on Light Masking Shutter (22) material type, locking the two lower (outer) Light Masking Shutters (22) Illustrated in FIG. 21, FIG. 25 and FIG. 30 first, prior to locking the two upper (inner) Light Masking Shutters may be required if Light Masking Shutter (22) material type is not flexible enough.

Figure 17:
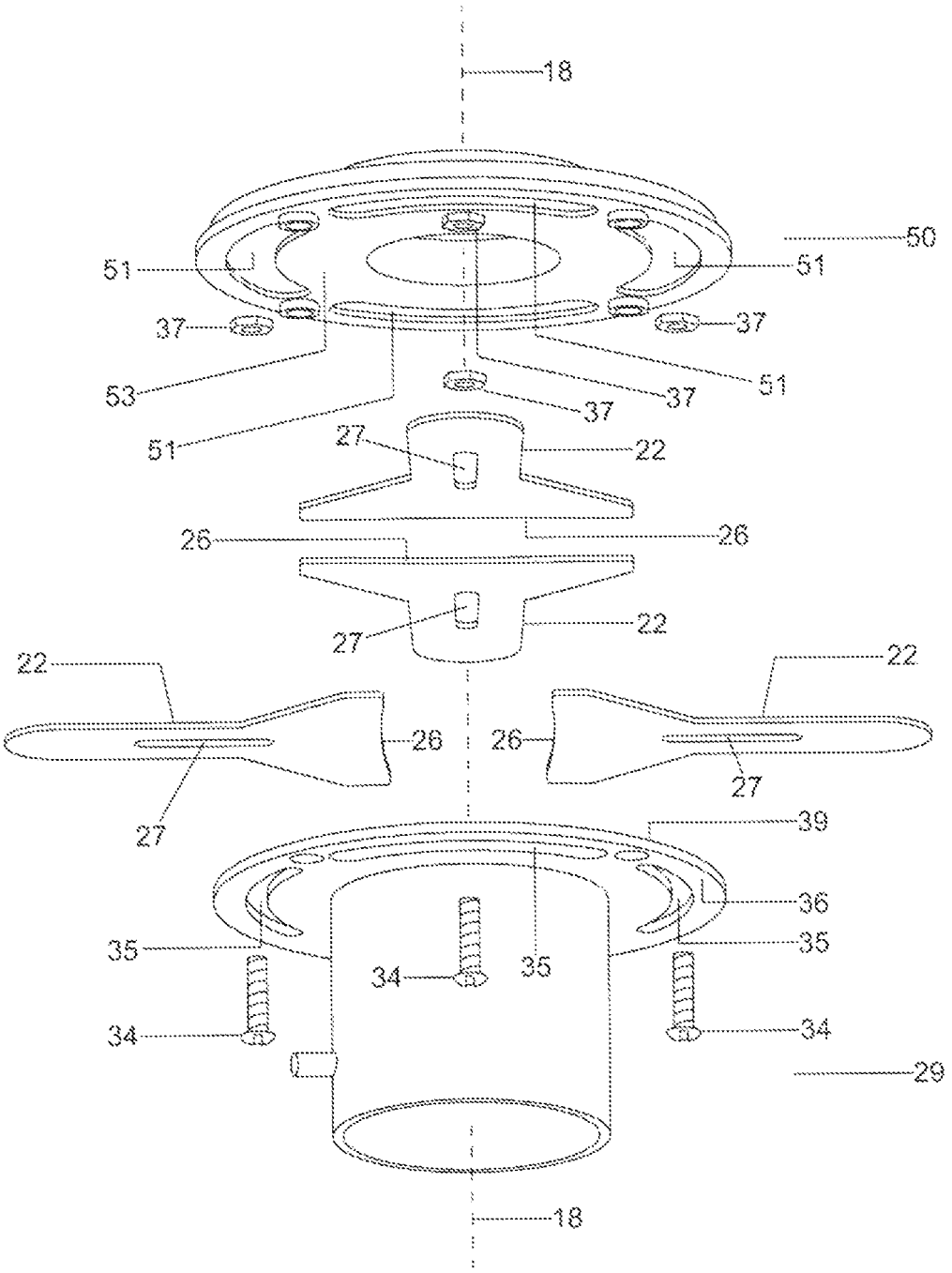
FIG. 17 depicts an isometric drawing showing components before assembly of a forward access independent light mask shutter locking system that utilizes a shutter gate with radial grooves to retain nuts from spinning.
Figure 18:
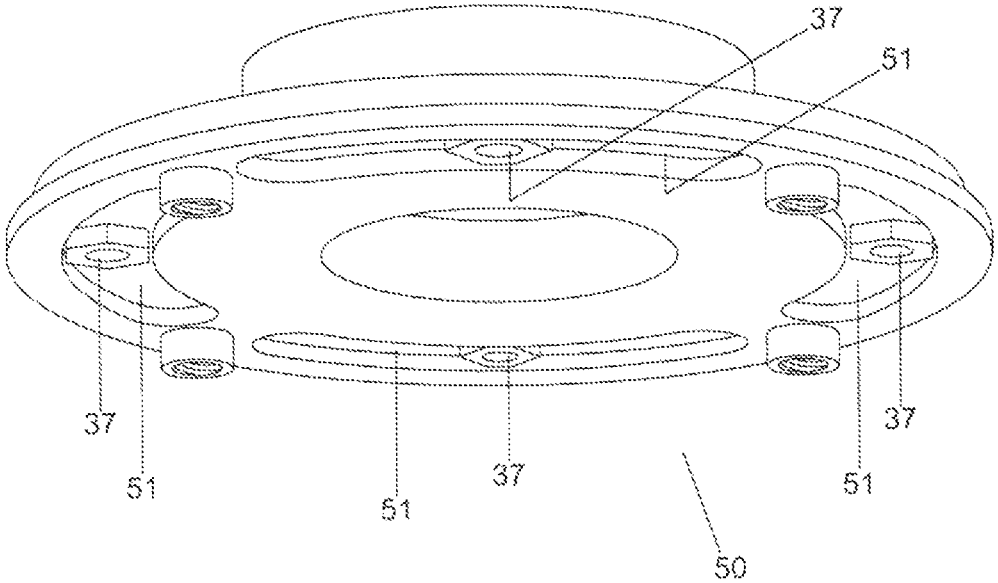
FIG. 18 depicts an isometric drawing showing an enlarged detailed view of a shutter gate with radial grooves to retain nuts from spinning for use in a forward access independent light mask shutter locking system.

FIGS. 17, 18 are isometric drawings illustrating a portion of the first set of embodiments including components and features for a Forward Access Independent Light Mask Shutter Locking System. A Front Cone (29) includes a Front Cone Flange (36) having Radial Slots (35) with the Radial Slots (35) width providing clearance for the threaded portion of Screw (34) to pass through. Front Cone Flange (36) includes an inside Plane B (39) that can make contact with Light Masking Shutters (22). Light Masking Shutters (22) include Light Masking Edges (26), Shutter Adjustment Screw Slots (27) having a slot width providing clearance for the threaded portion of Screws (34) to pass through. Light Mask Shutter Gate (50) includes Radial Grooves (51) that capture Nuts (37) shown in FIG. 18, with the groove width slightly wider than the outside width across the flat of Nuts (37) to capture Nuts (37) within Radial Grooves (51), to retain Nuts (37) from spinning, but allowing Nuts (37) to travel within the length of the Radial Grooves (51) around the Light Axis (18) with travel limited to Radial Grooves (51) length. Light Mask Shutter Gate (50) includes an outside Plane A (53) that can make contact with Light Masking Shutters (22). The radius dimension to the center of the Front Cone Flange (36) Radial Slots (35) is equal to the radius dimension to the center of the Light Mask Shutter Gate (50) Radial Grooves (51) with the center of the radius being the Light Axis (18).

Figure 19:
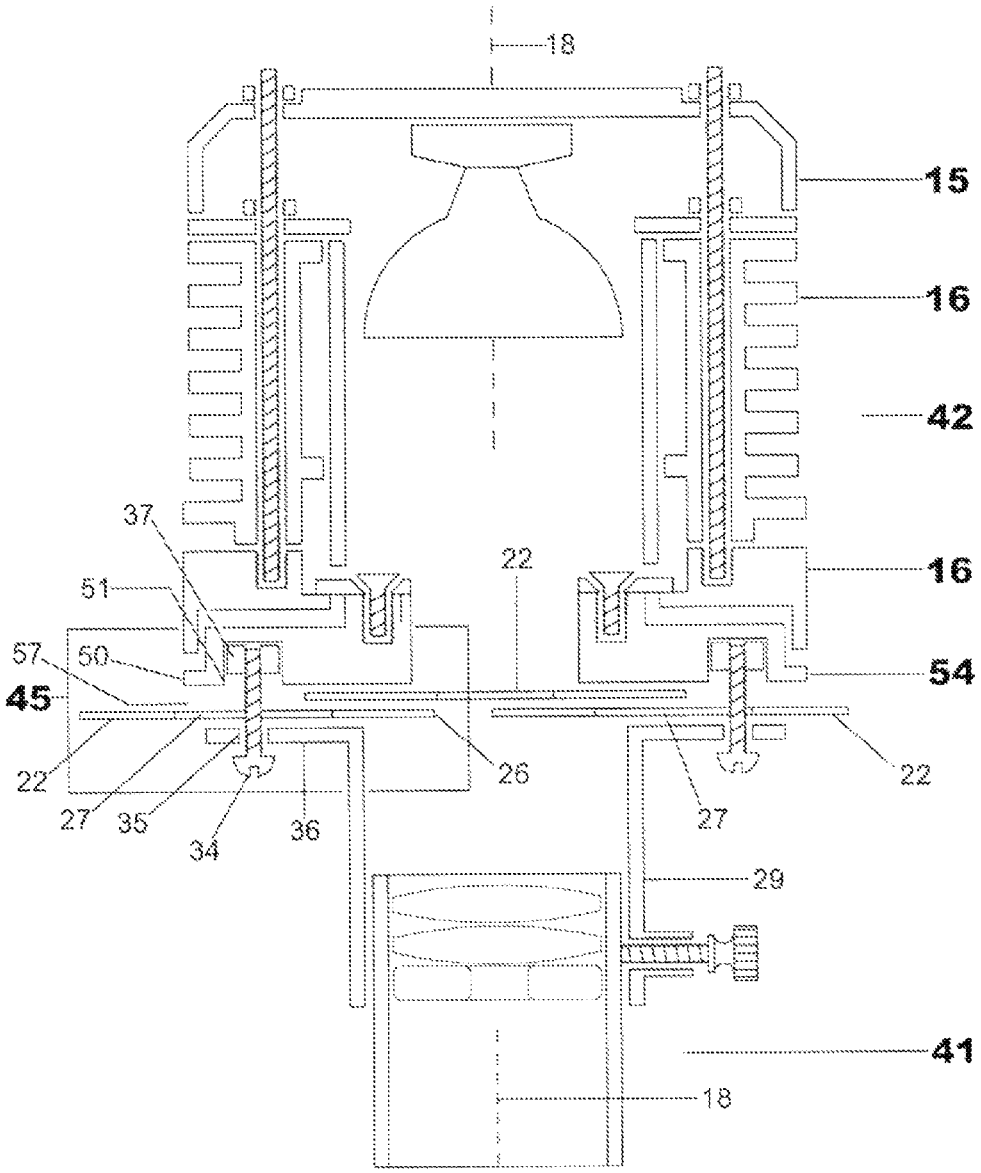
FIG. 19 depicts a section drawing for an assembled forward access independent light mask shutter locking system that utilizes a shutter gate with radial grooves to retain nuts.
Figure 20:
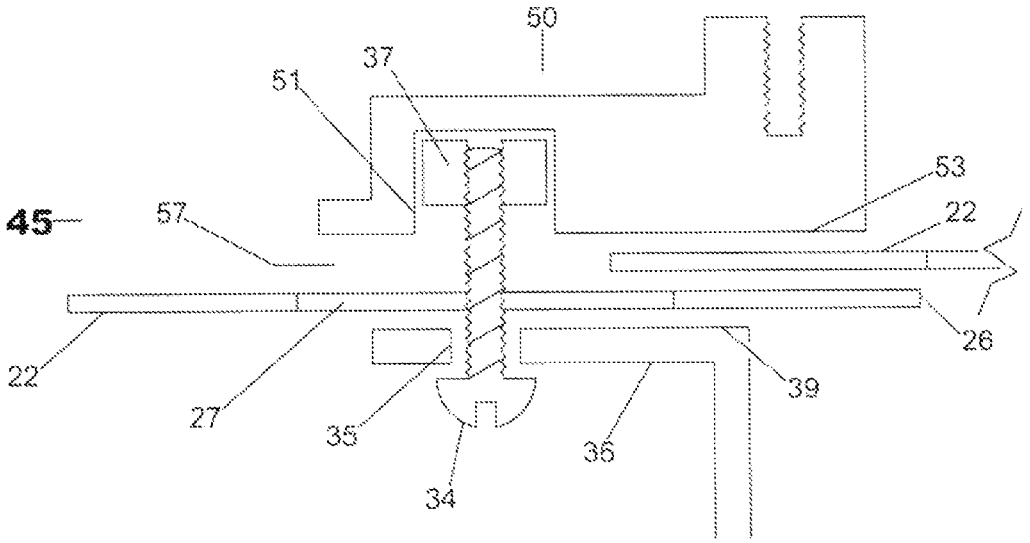
FIG. 20 depicts an enlarged section drawing for an assembled forward access independent light mask shutter locking system that utilizes a shutter gate with radial grooves to retain a nut shown in an un-locked shutter condition.
Figure 21:
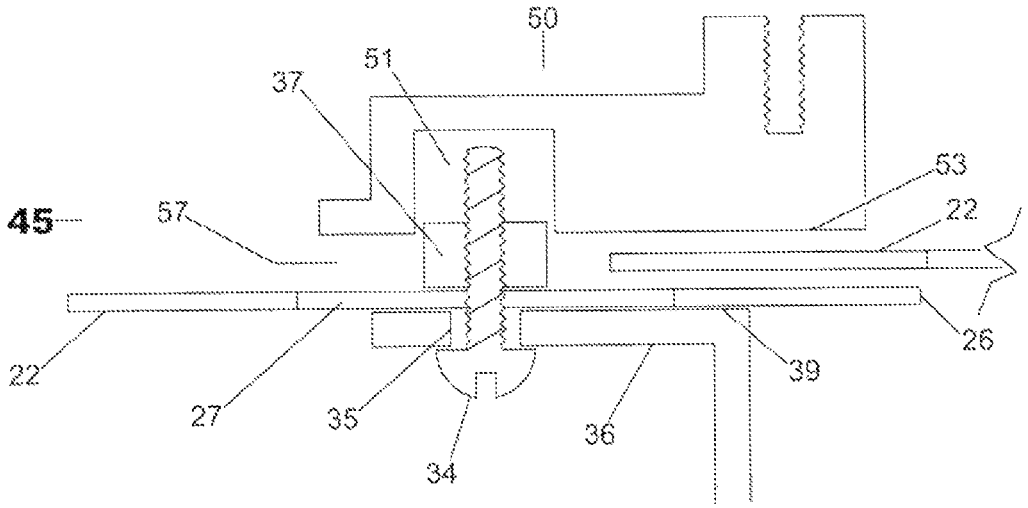
FIG. 21 depicts an enlarged section drawing for an assembled forward access independent light mask shutter locking system that utilizes a shutter gate with radial grooves to retain a nut shown in a locked shutter condition.

FIGS. 19, 20, 21 are section drawings continuing description for the first set of embodiments illustrating a portion of an assembled Forward Access Optical Framing Projector Assembly (42) including the components, fasteners, and features for a Forward Access Independent Light Mask Shutter Locking System (45) detailed in FIGS. 20, 21.

FIG. 19 is an embodiment for A Forward Access Independent Light Mask Shutter Locking System (45) that includes a Screw (34) extending through a Radial Slot (35) of a Front Cone Flange (36) with Screw (34) also extending through a Shutter Adjustment Screw Slot (27) of a Light Masking Shutter (22) having a Light Masking Edge (26) with Light Masking Shutter (22) positioned within a Light Mask Slot (57) and Screw (34) threaded into Nut (37) captured in a Radial Groove (51) of a Light Mask Shutter Gate (50).

The center line for Radial Slot (35) aligned with the center line of Radial Groove (51) guides Screw (34) and Nut (37) respectively. Screw (34) threads into Nut (37) and both combined rotate equidistantly around the Light Axis (18), and when Screw (34) extends through a Shutter Adjustment Screw Slot (27) of a Light Masking Shutter (22), the resulting assembly does not limit Light Masking Shutter (22) variable adjustment requirements described in FIG. 1C FIG. 20 is an enlarged view of the Forward Access Independent Light Mask Shutter Locking System (45) called out by a rectangle in FIG. 19. FIG. 20 illustrates an unlocked Light Masking Shutter (22) with Screw (34) not tightened into Nut (37) and with Light. Masking Shutter (22) floating between Plane B (39) and Plane A (53).

FIG. 21 is an enlarged view of a Forward Access Independent Light Mask Shutter Locking System (45) called out by a rectangle in FIG. 19 but with FIG. 21 illustrating a locked Light Masking Shutter (22) with Screw (34) tightened into Nut (37) and compressing Light Masking Shutter (22) between the face of Nut (37) and Plane B (39).

FIGS. 18, 22, 23, 24, 25 are drawings illustrating a portion of the second set of embodiments including components and features for a Forward Access Independent Light Mask Shutter Locking System (45) including combining Light Masking Shutters (22) with a Shutter Separator Plate (56) positioned in a Light Mask Slot (57) of a Light Mask Shutter Gate (50) having Radial Grooves (51) to retain Nuts (37) from spinning.

Figure 22:
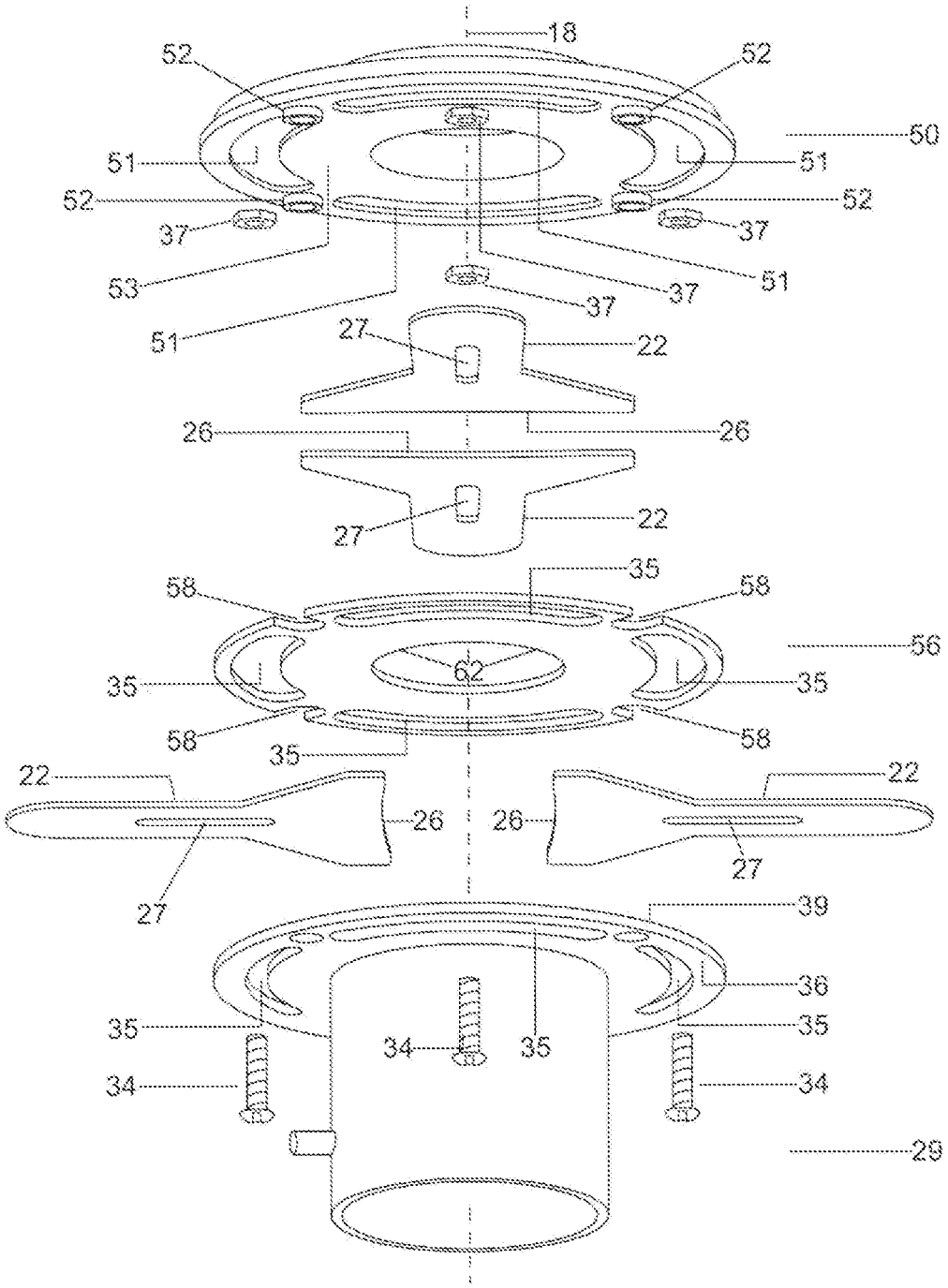
FIG. 22 depicts an isometric drawing showing components before assembly of a forward access independent light mask shutter locking system in combination with a shutter separator plate for a system that utilizes a shutter gate with radial grooves to retain nuts.

FIGS. 18, 22 are isometric drawings illustrating a portion of the second set of embodiments including components and features for a Forward Access Independent Light Mask Shutter Locking System. A Front Cone (29) includes a Front Cone Flange (36) having Radial Slots (35) with the Radial Slots (35) width providing clearance for the threaded portion of Screw (34) to pass through. Front Cone Flange (36) includes an inside Plane B (39) that can make contact with Light Masking Shutters (22). Light Masking Shutters (22) include Light Masking Edges (26), Shutter Adjustment Screw Slots (27) having a slot width providing clearance for the threaded portion of Screws (34) to pass through. Light Masking Shutters (22) are separated by a Shutter Separator Plate (56) to reduce conflict between perpendicular Light Masking Shutters (22) from binding during adjustment. Shutter Separator Plate (56) includes, Clearance Openings (58) that provide a clear fit around Standoffs (52), an Inner Opening (62) for light to pass through, Radial Slots (35) with the slot width wider than the outside width across the flat of Nuts (37). Light Mask Shutter Gate (50) includes Radial Grooves (51) that capture Nuts (37) shown in FIG. 18, with the groove width slightly wider than the outside width across the flat of Nuts (37) to capture Nuts (37) within Radial Grooves (51), to retain Nuts (37) from spinning, but allowing Nuts (37) to travel within the length of the Radial Grooves (51) around the Light Axis (18) with travel limited to Radial Grooves (51) length. Light Mask Shutter Gate (50) includes an outside Plane A (53) that can make contact with Light Masking Shutters (22). The radius dimension to the center of the Front Cone Flange (36) Radial Slots (35) is equal to the radius dimension to the center of the Light Mask Shutter Gate (50) Radial Grooves (51) with the center of the radius being the Light Axis (18).

Figure 23:
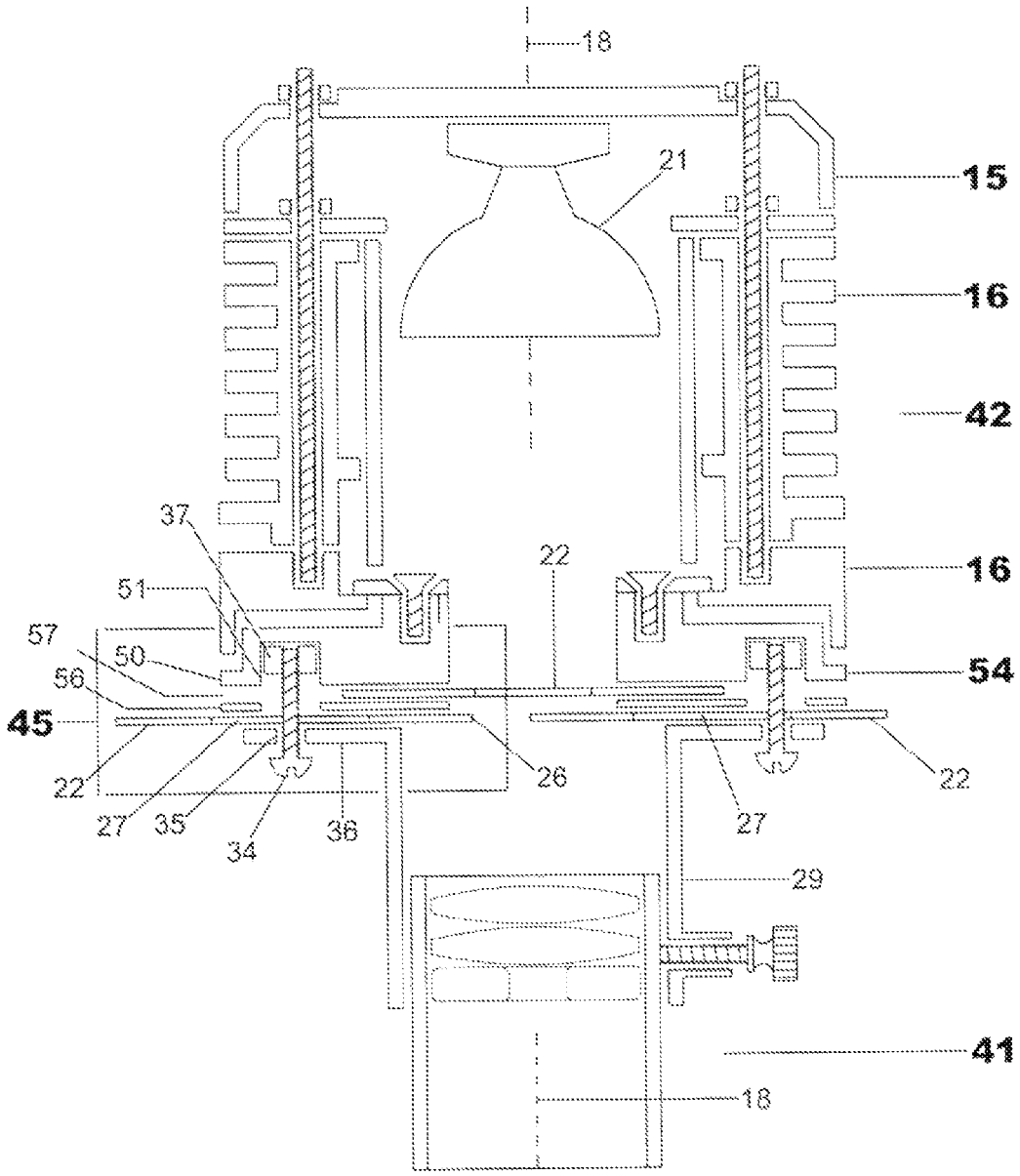
FIG. 23 depicts a section drawing for an assembled forward access independent light mask shutter locking system in combination with a shutter separator plate for a system that utilizes a shutter gate with radial grooves to retain nuts.
Figure 24:
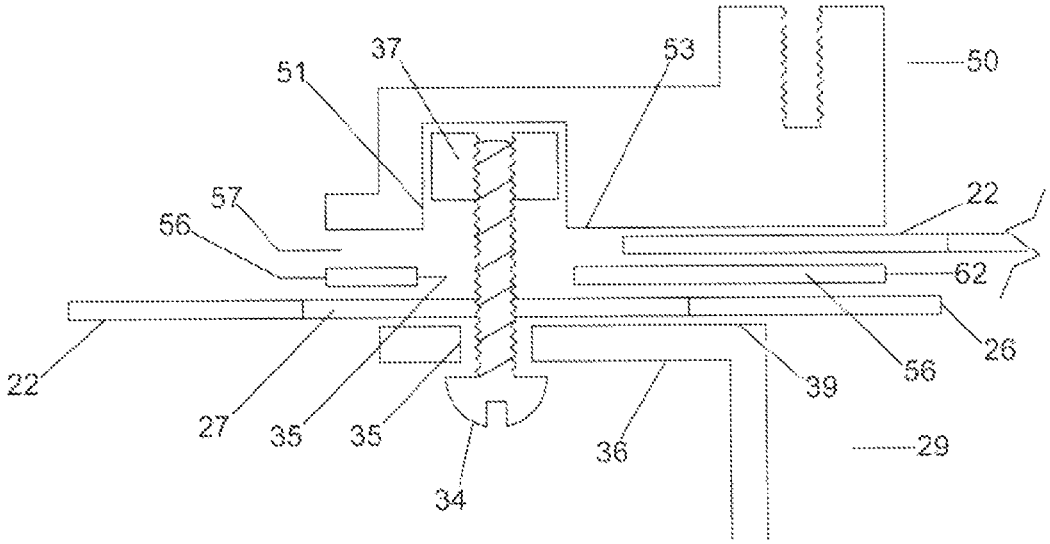
FIG. 24 depicts an enlarged section drawing for an assembled forward access independent light mask shutter locking system in combination with a shutter separator plate for a system that utilizes a shutter gate with radial grooves to retain a nut shown in an un-locked shutter condition.
Figure 25:
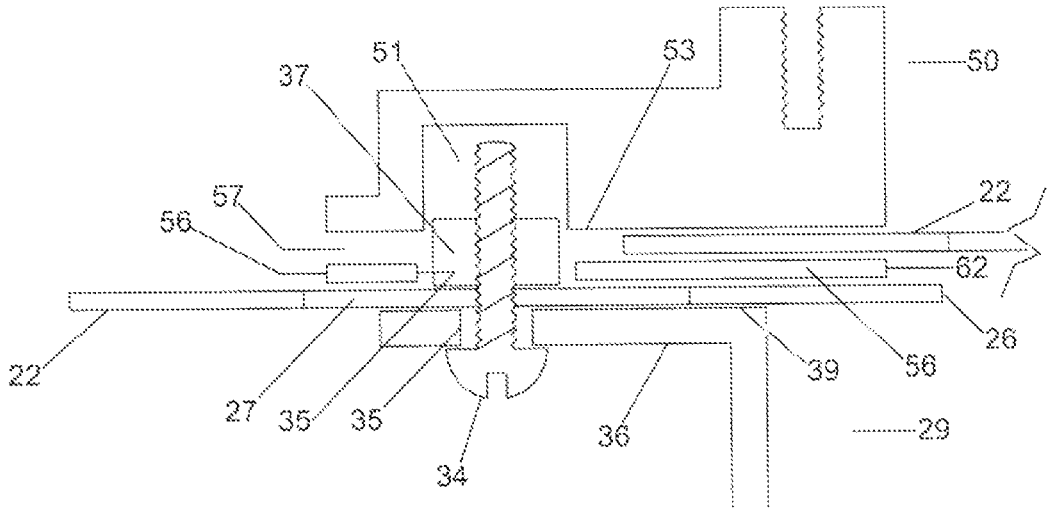
FIG. 25 depicts an enlarged section drawing for an assembled forward access independent light mask shutter locking system in combination with a shutter separator plate for a system that utilizes a shutter gate with radial grooves to retain a nut shown in a locked shutter condition.
Figure 26:
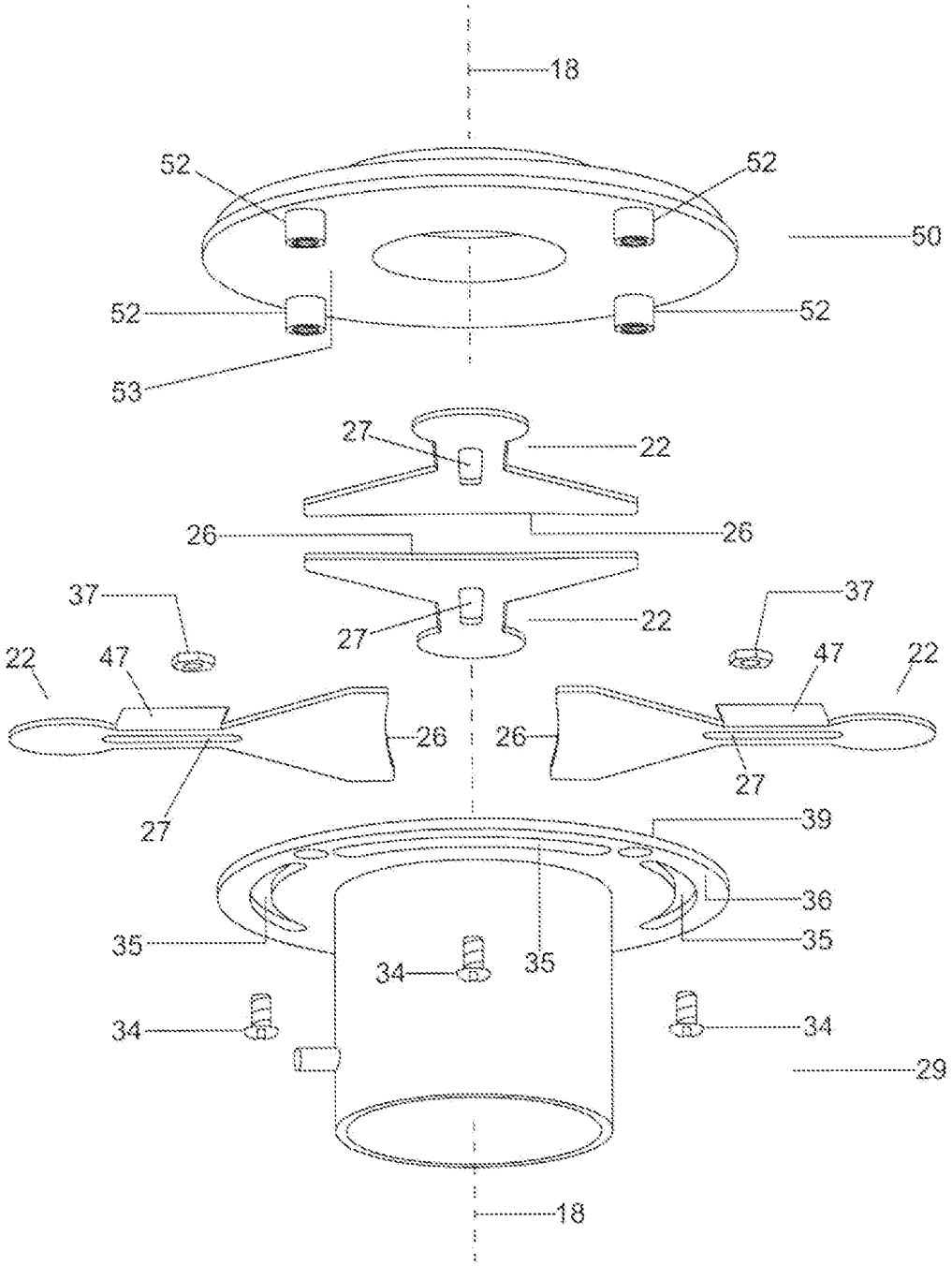
FIG. 26 depicts an isometric drawing showing components before assembly of a forward access independent light mask shutter locking system that utilizes light masking shutters having nut retainer tabs to retain nuts from spinning.

FIGS. 23, 24, 25 are section drawings continuing description for the second set of embodiments illustrating a portion of an assembled Forward Access Optical Framing Projector Assembly (42) including the components, fasteners, and features for a Forward Access Independent Light Mask Shutter Locking System (45) including a Shutter Separator Plate (56) detailed in FIGS. 24, 25.

FIG. 23 is an embodiment for A Forward Access Independent Light Mask Shutter Locking System (45) that includes a Screw. (34) extending through a Radial Slot (35) of a Front Cone Flange (36) with Screw (34) also extending through a Shutter Adjustment Screw Slot (27) of a Light Masking Shutter (22) having a Light Masking Edge (26) with Light Masking Shutter (22) positioned within a Light Mask Slot (57) and Screw (34) also extending through a Radial Slot (35) of a Shutter Separator Plate (56) and Screw (34) threaded into Nut (37) captured from spinning in a Radial Groove (51) of a Light Mask Shutter Gate (50).

The center line for Radial Slot (35) aligned with the center line of Radial Groove (51) guides Screw (34) and Nut (37) respectively. Screw (34) threads into Nut (37) and both combined rotate equidistantly around the Light Axis (18), and when Screw (34) extends through a Shutter Adjustment Screw Slot (27) of a Light Masking Shutter (22), the resulting assembly does not limit Light Masking Shutter (22) variable adjustment requirements described in FIG. 1C and Light Masking Shutters (22) are separated by a Shutter Separator Plate (56) to reduce conflict between perpendicular Light Masking Shutters (22) from binding during adjustment.

FIG. 24 is an enlarged view of the Forward Access Independent Light Mask Shutter Locking System (45) called out by a rectangle in FIG. 23. FIG. 24 illustrates an unlocked Light Masking Shutter (22) with Screw (34) not tightened into Nut (37) and with Light Masking Shutter (22) floating between Plane B (39) and the outside lower face of the Shutter Separator Plate (56).

FIG. 25 is an enlarged view of a Forward Access Independent Light Mask Shutter Locking System (45) called out by a rectangle in FIG. 23. FIG. 25 illustrates a locked Light Masking Shutter (22) with Screw (34) tightened into Nut (37) and compressing Light Masking Shutter (22) between the face of Nut (37) and Plane B (39) and with Nut (37) not making contact with the Shutter Separator Plate (56) through an oversized Radial Slot (35) width in the Shutter Separator Plate (56). The back side of a screw (34) head touches the front cone flange (36), isolating the back side of the screw (34) head from the light masking shutter (22), so that when the screw (34) is rotated the position of the light masking shutter (22) is unchanged.

FIGS. 26, 27, 28, 29, 30 describe the third set of embodiments for a Forward Access Independent Light Mask Shutter Locking System (45) including Light Masking Shutters (22) having Nut Retainer Tabs (47) to capture Nuts (37) with Light Masking Shutters (22) positioned in a Light Mask Slot (57) of a Light Mask Shutter Gate (50).

FIGS. 26, 27, 28, 29, 30 are drawings illustrating a portion of the third set of embodiments including components and features for a Forward Access Independent Light Mask Shutter Locking System. A Front Cone (29) includes a Front Cone Flange (36) having Radial Slots (35) with the Radial Slots (35) width providing clearance for the threaded portion of Screw (34) to pass through. Front Cone Flange (36) includes an inside Plane B (39) that can make contact with Light Masking Shutters (22). Light Masking Shutters (22) are preferably made from a spring type material and include, Light Masking Edges (26), Shutter Adjustment Screw Slots (27) having a slot width providing clearance for the threaded portion of Screws (34) to pass through, and Nut Retainer Tabs (47) that can receive and capture Nuts (37). Light Mask Shutter Gate (50) includes, an outside Plane A (53) that can make contact with Light Masking Shutters (22) Nut Retainer Tabs (47), and long Standoffs (52) with a dimensional height for a Light Mask Slot (57) that provides space to accommodate Light Masking Shutters (22) having Nut Retainer Tabs (47) to move freely within Light Mask Slot (57).

Figure 27:
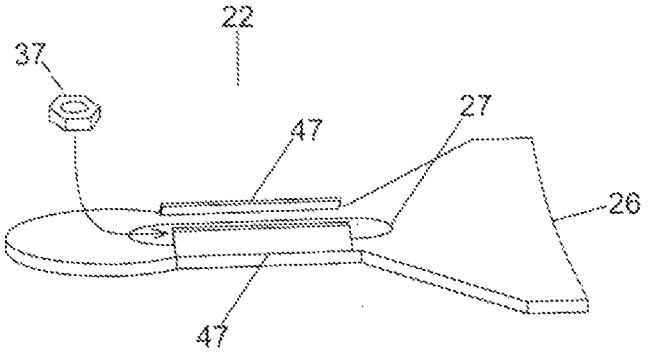
FIG. 27 depicts an isometric drawing showing a light masking shutter having nut retainer tabs to retain nuts from spinning for use in a forward access independent light mask shutter locking system.

FIG. 27 is an isometric drawing illustrating a Light Masking Shutter (22) having Nut Retainer Tabs (47) deigned to receive and capture Nut (37) after being inserted into one of the Nut Retainer Tabs (47) ends illustrated by arrow.

Figure 28:
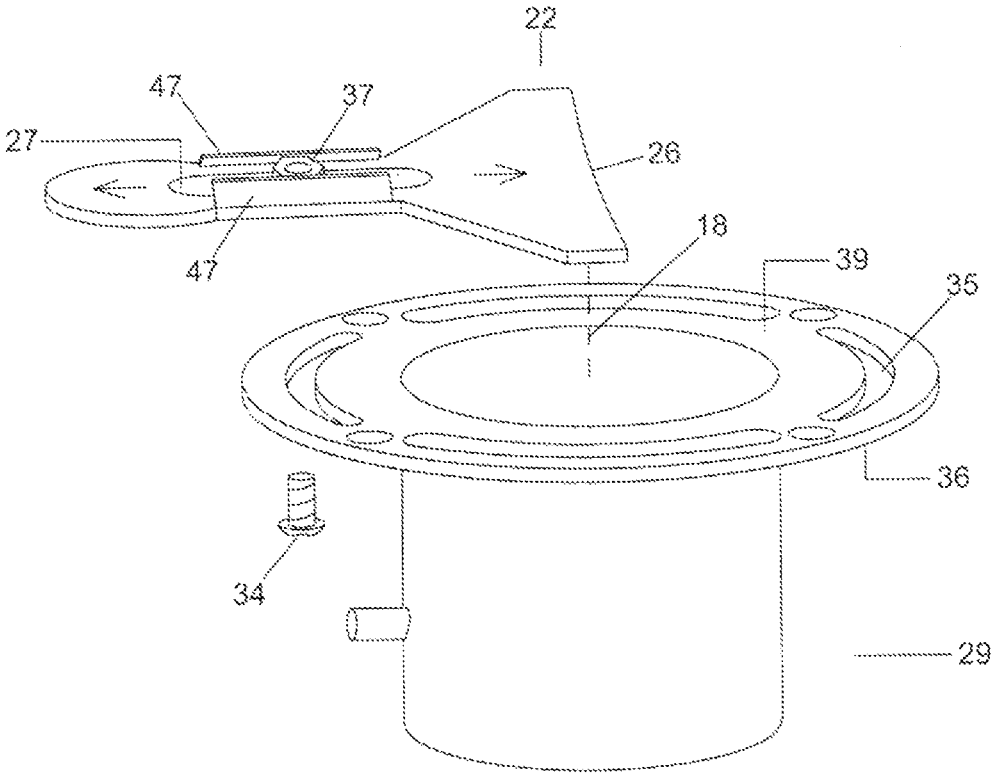
FIG. 28 depicts an isometric drawing showing the interaction between a light masking shutter having nut retainer tabs and a front cone flange with radial slots for use in a forward access independent light mask shutter locking system.

FIG. 28 is an isometric drawing illustrating Light Masking Shutter (22) with Nut (37) captured by slight compression within Nut Retainer Tabs (47) and with the slight compression level-allowing Nut (37) to slide and travel within Nut Retainer Tabs (47) in the directions shown by arrows. After assembly of the FIG. 28 embodiment, Nut Retainer Tabs (47) slight compression is designed to allow Light Masking Shutter (22) to slide along Nut (37) in/out perpendicular to the Light Axis (18) in the directions shown by arrows as well as retain Nut (37) from spinning when Screw (34) is threaded into Nut (37) as illustrated in the FIG. 29 assembly.

Figure 29:
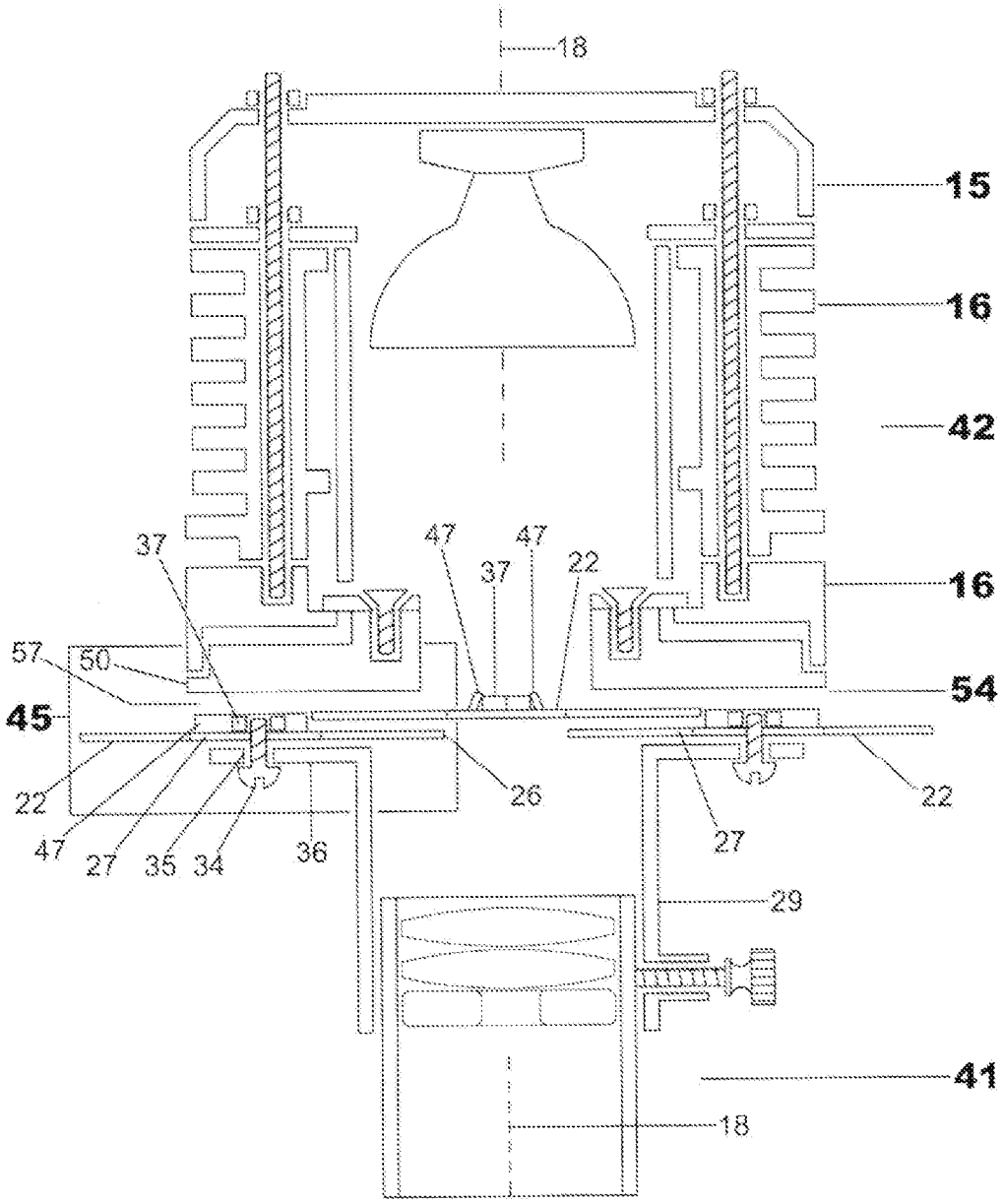
FIG. 29 depicts a section drawing for an assembled forward access independent light mask shutter locking system that utilizes nut retainer tabs to retain nuts from spinning.
Figure 30:
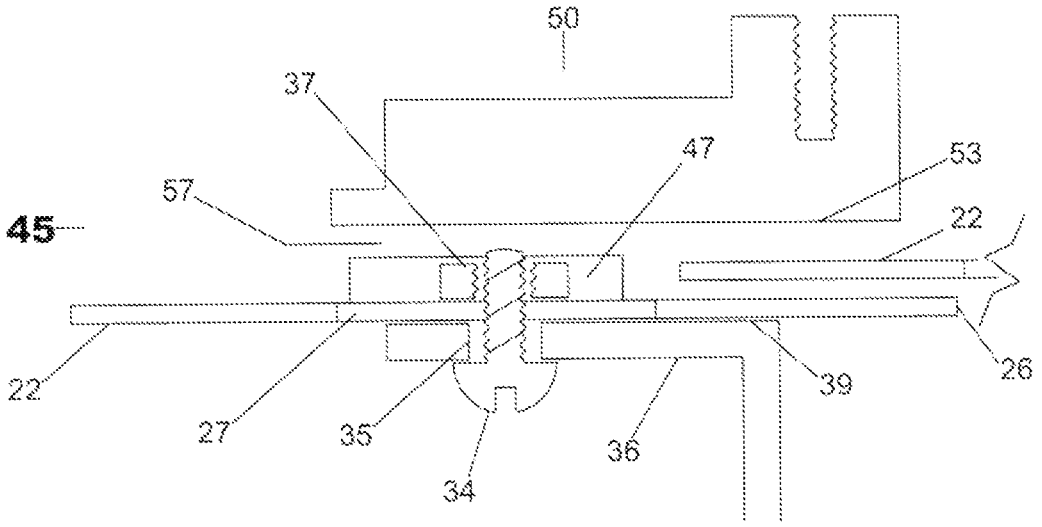
FIG. 30 depicts an enlarged section drawing for an assembled forward access independent light mask shutter locking system that utilizes a nut retainer tab to retain a nut shown in a locked shutter condition.

FIGS. 29, 30 are section drawings continuing description for the third set of embodiments illustrating a portion of an assembled Forward Access Optical Framing Projector Assembly (42) including the components, fasteners, and features for a Forward Access Independent Light Mask Shutter Locking System (45) detailed in FIG. 30.

FIG. 29 is an embodiment for a Forward Access Independent Light Mask Shutter Locking System (45) that includes a Screw (34) extending through a Radial Slot (35) of a Front Cone Flange (36) with Screw (34) also extending through a Shutter Adjustment Screw Slot (27) of a Light Masking Shutter (22) having a Light Masking Edge (26) with Light Masking Shutter (22) positioned within a Light Mask Slot (57) and Screw (34) threaded into Nut (37) captured from spinning by Nut Retainer Tabs (47) of a Light Masking Shutter (22).

Screw (34) threads into Nut (37) and both combined rotate equidistantly around the Light Axis (18) guided by a Radial Slot (35) with travel length limited to Radial Slot (35) length, and when Screw (34) extends through a Shutter Adjustment Screw Slot (27) of a Light Masking Shutter (22) that includes Nut Retainer Tabs (47) to retain Nut (37), the resulting assembly also provides Light Masking Shutter (22) with guided rotation around the Light Axis (18) and furthermore the resulting assembly does not limit Light Masking Shutter (22) variable adjustment requirements described in FIG. 1C.

FIG. 30 is an enlarged view of a Forward Access Independent Light Mask Shutter Locking System (45) called out by a rectangle in FIG. 29. FIG. 30 illustrates a locked Light Masking Shutter (22) with Screw (34) tightened into Nut (37) and compressing Light Masking Shutter (22) between the face of Nut (37) and Plane B (39) with Nut (37) captured by a Nut Retainer Tab (47).

Figure 31:
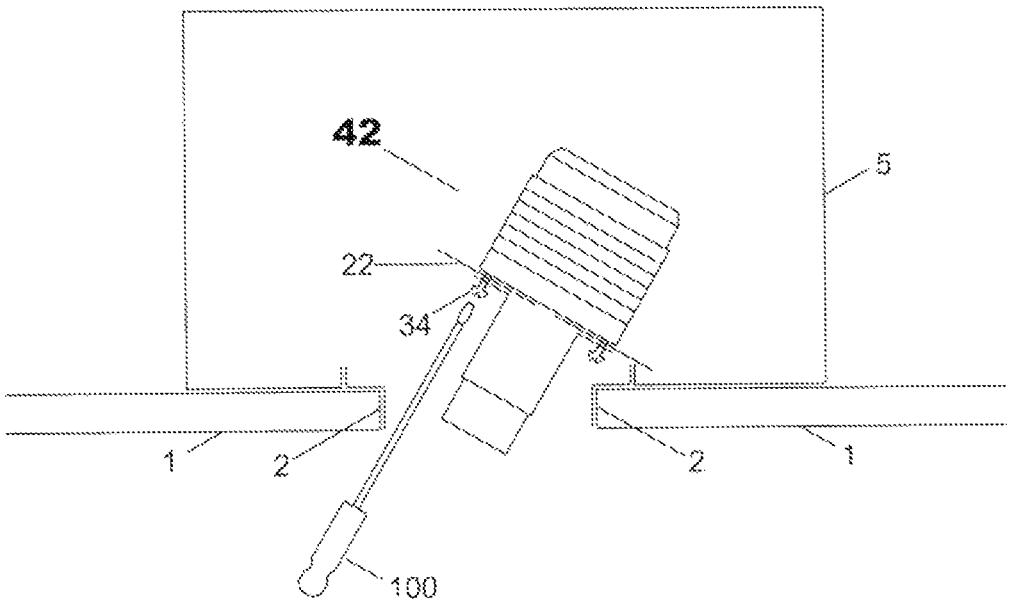
FIG. 31 depicts a section drawing showing a forward access independent light mask shutter locking system utilized on a forward access optical framing projector assembly recessed within the finished surface plane of a structure.

FIG. 31 is a sectional drawing illustrating a recessed Forward Access Optical Framing Projector Assembly (42) installed within a Recessed Housing (5) with Driver (100) nearly ready to drive Screw (34) to either lock or unlock any of the described Forward Access Independent Light Mask Shutter Locking Systems (45) from the front end of a projector, with the Forward Access Independent Light Mask Shutter Locking System (45) described providing a method to reduce the size of Opening In The Finished Surface Plane Of A Structure (2).

Light Masking Shutter with Adjustment Tool Slot

A forward access Light Masking Shutter With Adjustment Tool Slot (23) provides a forward access method to independently adjust shutters using a Driver (100) positioned at the front side and or sometimes parallel to the Light Axis (18) for a Forward Access Optical Framing Projector Assembly (42). The forward access Light Masking Shutter With Adjustment Tool Slot (23) facilitates for a safer hot light mask adjustment.

Figure 32:
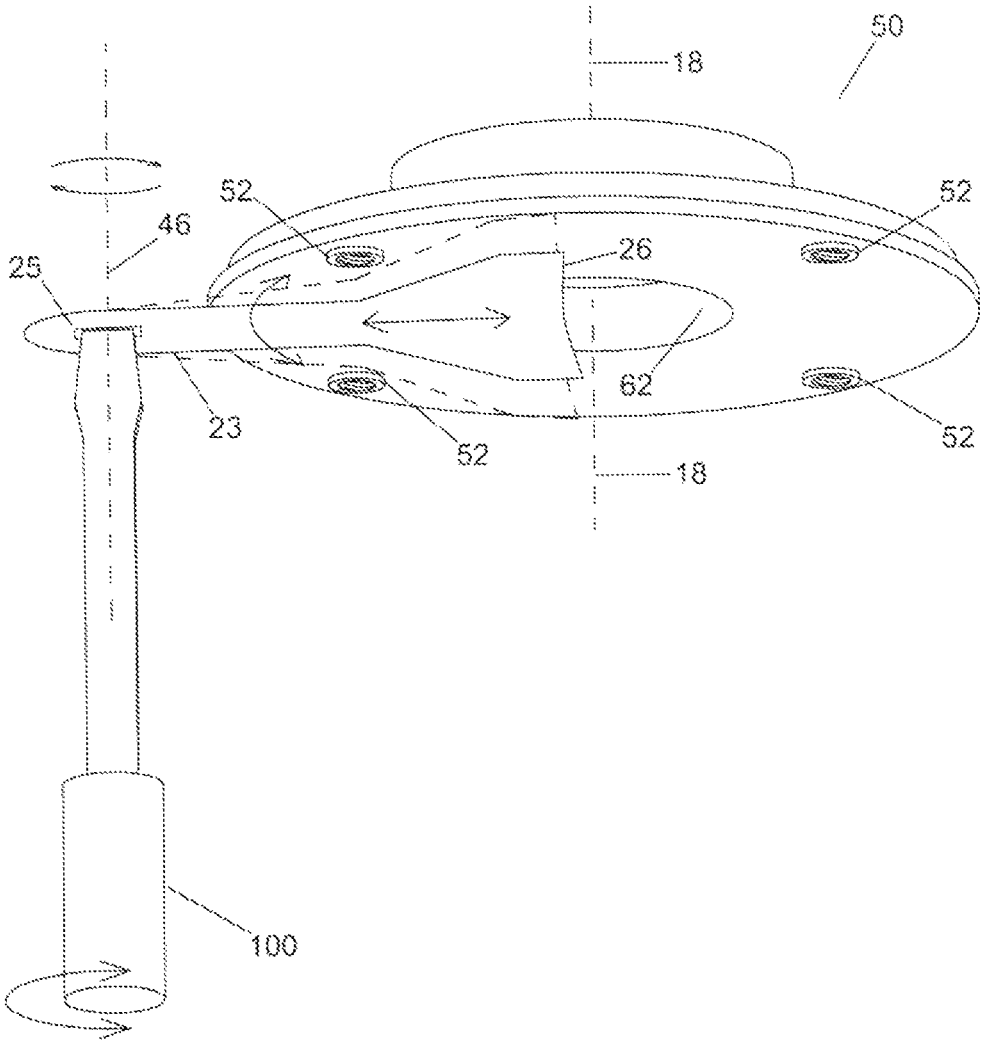
FIG. 32 depicts an isometric drawing of a light masking shutter with adjustment tool slot being adjusted by a rectangular shaped driver tip to obtain the variable shutter adjustment requirements.
Figure 33:
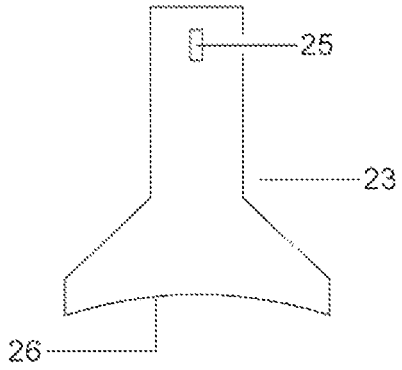
FIG. 33 depicts an elevation drawing illustrating features found on a light masking shutter with adjustment tool slot.
Figure 34:
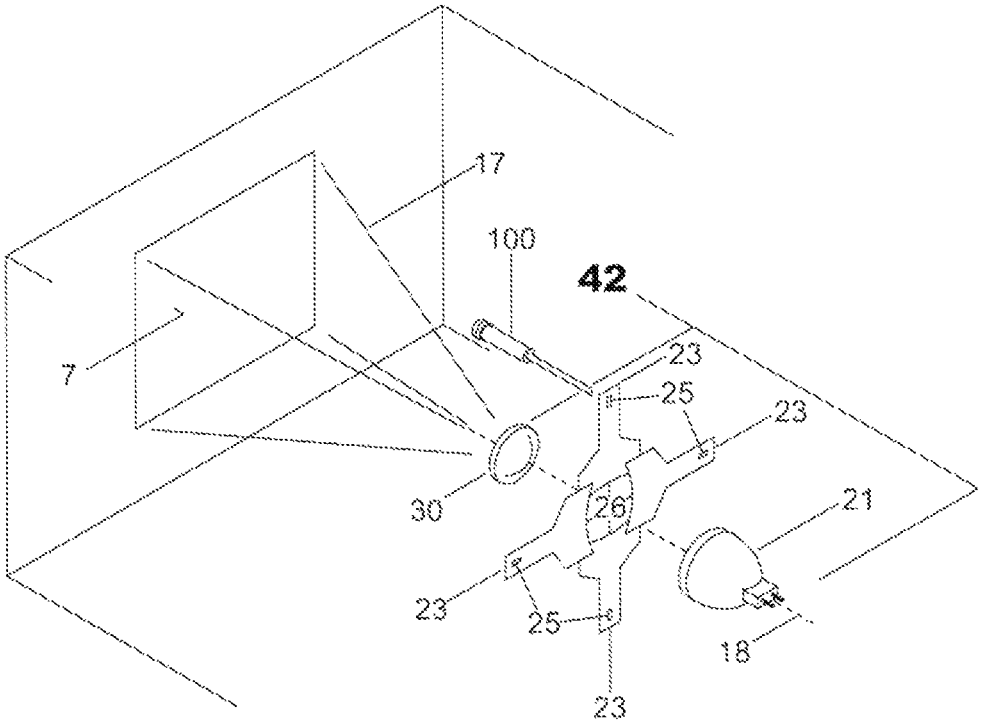
FIG. 34 depicts a schematic isometric drawing showing a driver capable of accurately adjusting light masking shutters with adjustment tool slots to obtain the variable shutter adjustment requirements and form a precisely shaped illumination zone.
Figure 35:
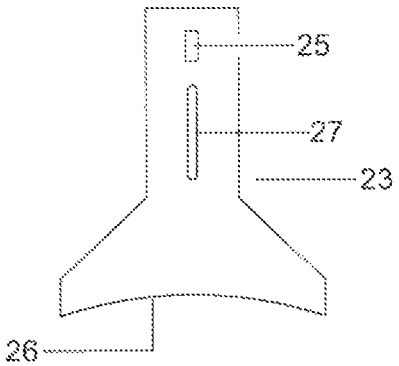
FIG. 35 depicts an elevation drawing illustrating features found on a light masking shutter with adjustment tool slot to also be applicable on a shutter that includes a shutter adjustment screw slot.
Figure 36:
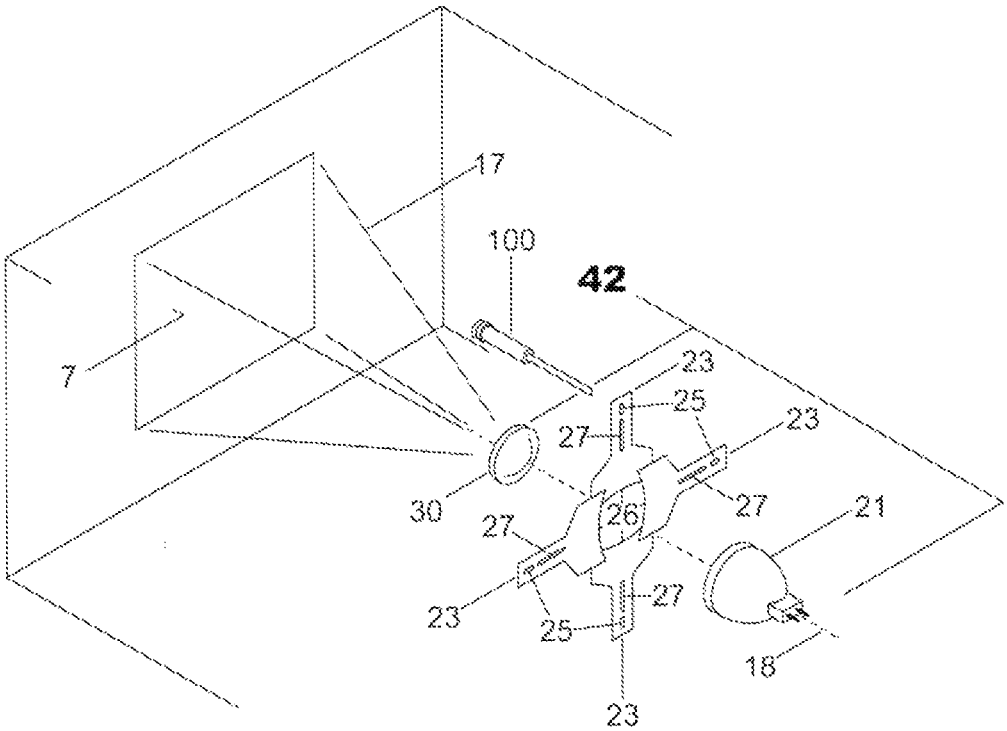
FIG. 36 depicts a schematic isometric drawing showing a driver capable of accurately adjusting light masking shutters with adjustment tool slots to obtain the variable shutter adjustment requirements when shutters include a shutter adjustment screw slot and used in a forward access independent light mask shutter locking system.

Two sets of embodiments for the forward access Light Masking Shutter With Adjustment Tool Slot (23) are disclosed. FIGS. 32, 33, 34 illustrate the first set of embodiments for a Light Masking Shutter With Adjustment Tool Slot (23) that do not include a Shutter Adjustment Screw Slot (27). FIGS. 35, 36 illustrate the second set of embodiments for a Light Masking Shutter With Adjustment Tool Slot (23) that includes a Shutter Adjustment Screw Slot (27).

Both sets of embodiments provide the ability to accurately control the variable shutter adjustment requirements described in FIG. 1C, with adjustment movement requirements including but not limited to, in/out perpendicular to the Light Axis (18), radially around the Light Axis (18), and radially around the Adjustment Contact Axis (46).

FIG. 32 is an isometric drawing illustrating a Driver (100) engaged into a Tool Slot (25) located in a position accessible for adjustment contact including when shutters are closed for a Light Masking Shutter With Adjustment Tool Slot (23) with the shutter including a Light Masking Edge (26) positioned over a portion of an Inner Opening (62) Of a Light Mask Shutter Gate (50) to shape light when light passes through, and Driver (100) having a rectangular tip shape such as a flat bladed screw driver engaged into the Tool Slot (25) of the Light Masking Shutter With Adjustment Tool Slot (23) with Tool Slot (25) shaped to receive a rectangular shaped Driver (100) tip and Driver (100) providing the ability to accurately control the variable shutter adjustment movement requirements including but not limited to, in/out perpendicular to the Light Axis (18) illustrated by arrows, radially around the Light Axis (18) illustrated by arrows, and radially around the Adjustment Contact Axis (46) illustrated by arrows. FIG. 32 illustrates the Light Mask Shutter Gate (50) to include short Standoffs (52) for alternate projector configurations when shutters are retained into position by slight compression between Plane A (53) and Plane B (39) of a Light Mask Slot (57) not shown in this figure.

FIGS. 33, 34 continue description for the first set of embodiments illustrating a Light Masking Shutter With Adjustment Tool Slot (23). FIG. 33 is an elevation drawing illustrating a Light Masking Shutter With Adjustment Tool Slot (23) to include, a Light Masking Edge (26), and Tool Slot (25). FIG. 34 is a schematic isometric drawing of a Forward Access Optical Framing Projector Assembly (42) including a Light Source (21) projecting light through Light Masking Shutters With Adjustment Tool Slots (23) having an opening surrounded by Light Masking Edges (26) that confine and shape light after the shutters have been accurately adjusted using a Driver (100) engaged into a Tool Slot (25) with the Driver (100) positioned parallel to the Light Axis (18) and with the shaped light focused by an Objective Focal Lens 30 for projecting an Outbound Light Beam (17) to form a precisely shaped Illumination Zone (7) on a surface where it can be seen.

FIGS. 35, 36 contain the second et of embodiments illustrating a Light Masking Shutter With Adjustment Tool Slot (23) including a Shutter Adjustment Screw Slot (27) for use in any of the projector configurations illustrated as having a Forward Access Independent Light Mask Shutter Locking System (45) described previously. FIG. 35 is an elevation drawing illustrating a Light Masking Shutter With Adjustment Tool Slot (23) to include, a Shutter Adjustment Screw Slot (27), a Light Masking Edge (26), and Tool Slot (25) located in a position accessible for adjustment contact including when shutters are closed. FIG. 36 is a schematic isometric drawing of a Forward Access Optical Framing Projector Assembly (42) including a Light Source (21) projecting light through Light Masking Shutters With Adjustment Tool Slots (23) having an opening surrounded by Light Masking Edges (26) that confine and shape light after the shutters have been accurately adjusted using a Driver (100) engaged into a Tool Slot (25) with the Driver (100) positioned parallel to the Light Axis (18) and with the shaped light focused by an Objective Focal Lens (30) for projecting an Outbound Light Beam (17) to form a precisely shaped Illumination Zone (7) when shutter includes a Shutter Adjustment Screw Slot (27) and used in a Forward Access Independent Light Mask Shutter Locking System (45) with shutter locking assembly having no negative and or additional positive influence over the ability to accurately control the variable shutter adjustment movement requirements illustrated in FIG. 32.

Figure 37:
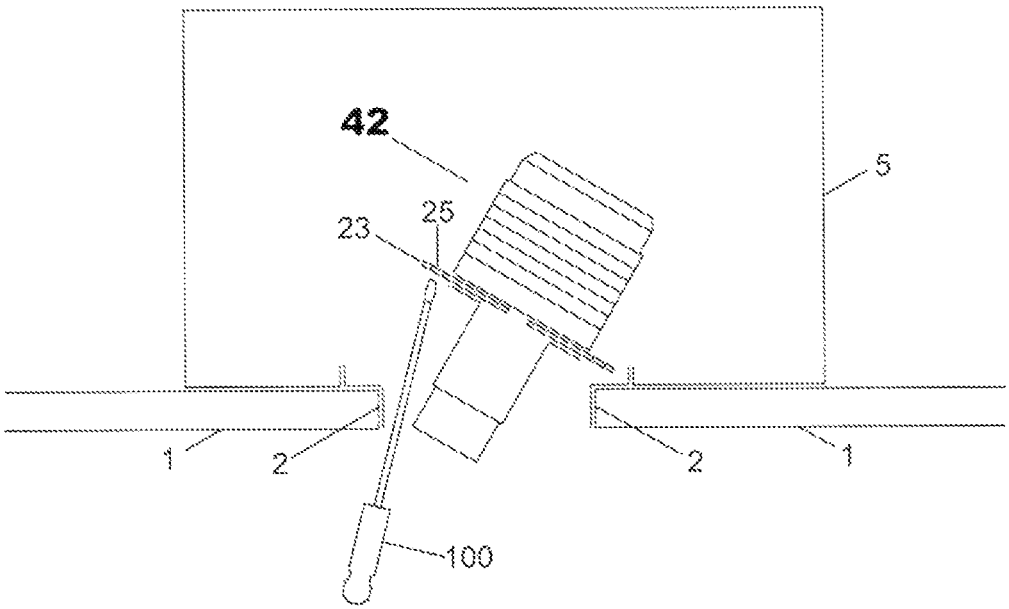
FIG. 37 depicts a section drawing showing a forward access light masking shutter with adjustment tool slot utilized on a forward access optical framing projector assembly recessed within the finished surface plane of a structure.

FIG. 37 is a sectional drawing illustrating a recessed Forward Access Optical Framing Projector Assembly (42) installed within a Recessed Housing (5) with Driver (100) nearly ready to engage into a Tool Slot (25) of a Light Masking Shutter With Adjustment Tool Slot (23) from the front side of a projector, with the Light Masking Shutter With Adjustment Tool Slot (23) described providing a method to reduce the size of Opening In The Finished Surface Plane Of A Structure (2).

FIGS. 32, 33, 34, 35, 36, 37 embodiments for a Light Masking Shutter With Adjustment Tool Slot (23) are by way of example using a rectangular shaped Tool Slot (25) and are not by way of limiting the shape of a Tool Slot (25) to being rectangular.

Figure 38:
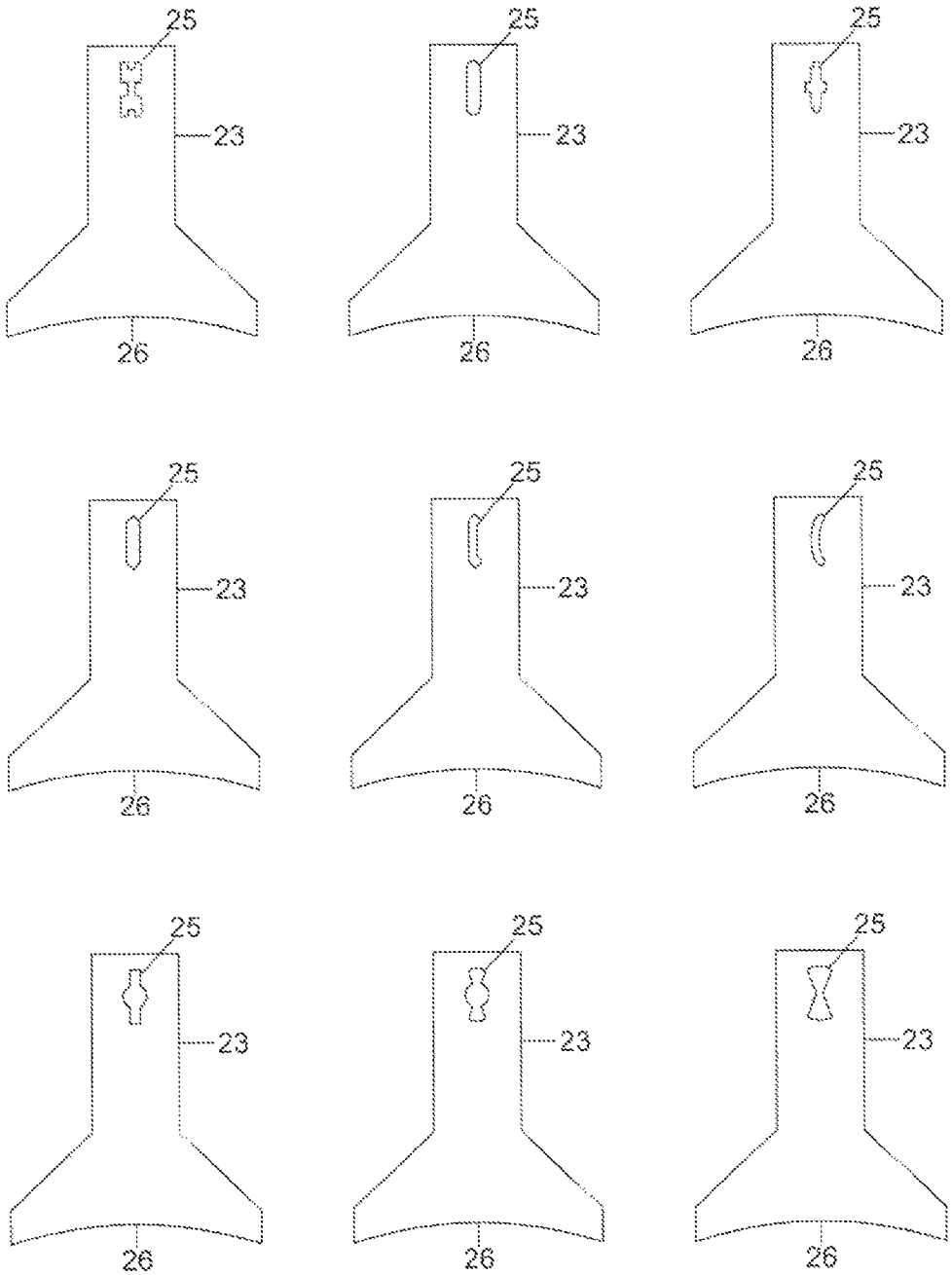
FIG. 38 depicts elevation drawings of light masking shutters with adjustment tool slots illustrating endless design shapes for a Tool Slot (25) that can receive a rectangular shaped driver.

FIG. 38 illustrates some additional Tool Slot (25) shapes located in a position accessible for adjustment contact including when shutters are closed for a Light Masking Shutter With Adjustment Tool Slot (23) that can receive a rectangular shaped Driver (100) tip providing the ability to accurately control the variable shutter adjustment movement requirements including but not limited to, in/out perpendicular to a Light Axis (18), radially around a Light Axis (18), and radially around an Adjustment Contact Axis (46). FIG. 38 Tool Slot (25) shapes are by way of example and not by way of limiting an endless design shape for a Tool Slot (25).

FIGS. 32, 33, 34, 35, 36, 37, 38 embodiments for a Light Masking Shutter With Adjustment Tool Slot (23) are by way of example using a Tool Slot (25) but are not by way of limiting other slot opening shapes located in a position accessible for adjustment contact including when shutters are closed for a Light Masking Shutter (22) that can receive a rectangular shaped Driver (100) tip providing the ability to accurately control the variable shutter adjustment movement requirements including but not limited to, in/out perpendicular to a Light Axis (18), radially around a Light Axis (18), and radially around an Adjustment Contact Axis (46).

Figure 39:
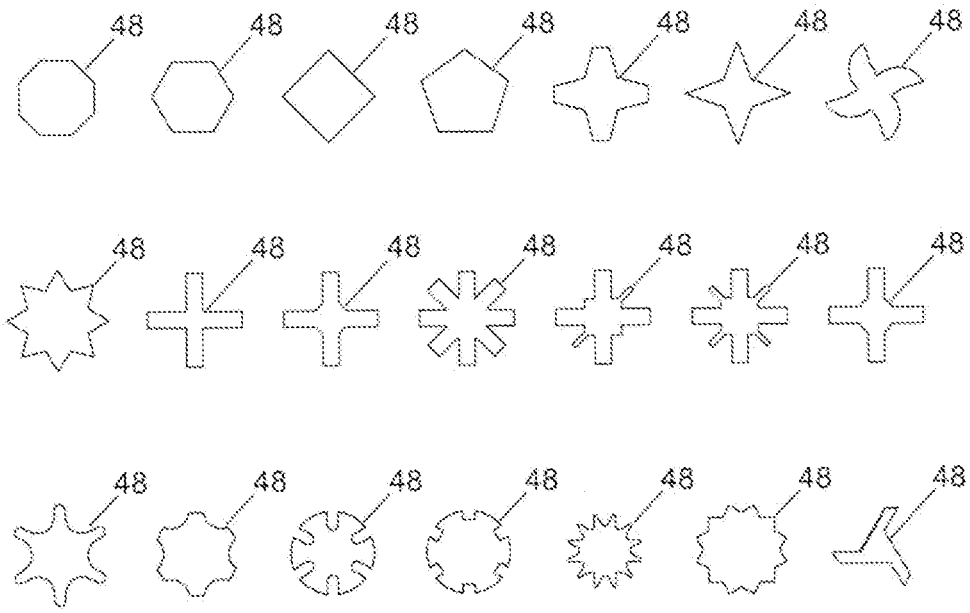
FIG. 39 depicts elevation drawings for endless tool opening shapes that can receive a rectangular shaped driver for a light masking shutter having a tool opening for adjustment by a driver.

FIG. 39 illustrates embodiments for some of many possible single non-elliptical and non-round Tool Opening (48) shapes that can be integrated into a Light Masking Shutter (22) not shown, with shapes that if located in a position accessible for adjustment contact including when a Light Masking Shutter (22) is closed, can receive a rectangular shaped Driver (100) tip providing the ability to accurately control the variable shutter adjustment movement requirements including but not limited to, in/out perpendicular to a Light Axis (18), radially around a Light Axis (18), and radially around an Adjustment Contact Axis (46) with FIG. 39 Tool Opening (48) shapes being by way of example and not by way of limiting endless design options for Tool Opening (48) shapes that can be engaged into for adjustment contact by a rectangular shaped Driver (100) tip.

Figure 40:
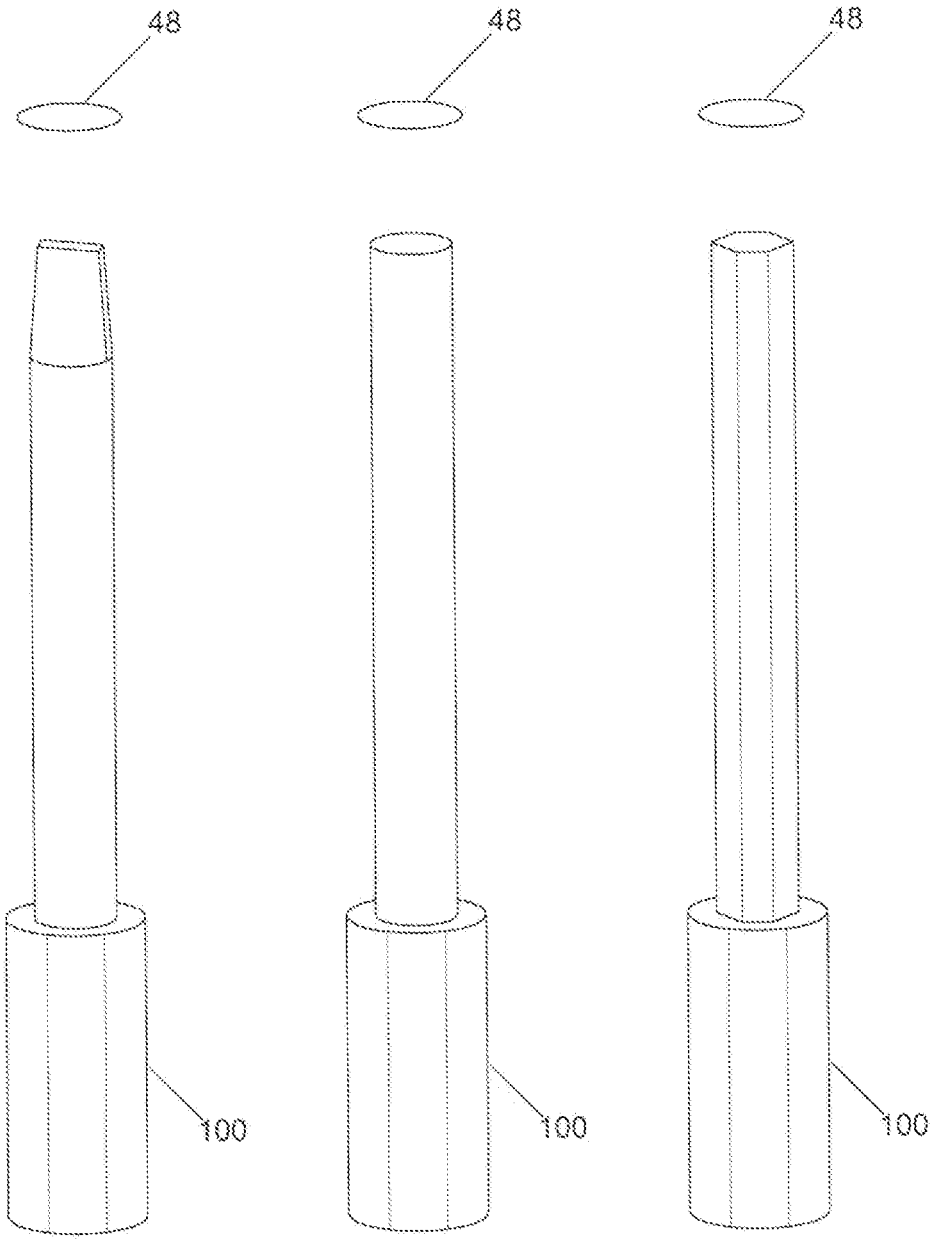
FIG. 40 depicts isometric drawings of an elliptical tool opening shape that can be integrated into a light masking shutter to receive endless shaped driver tips for shutter adjustment.

FIG. 40 includes isometric drawings illustrating embodiments for an elliptical Tool Opening (48) shape that can be integrated into a Light Masking Shutter (22) not shown in combination with a Driver (100), with elliptical Tool Opening (48) shape that if located in a position accessible for adjustment contact including when a Light Masking Shutter (22) is closed can be engaged into by either a rectangular, elliptical, or other shaped Driver (100) tip providing the ability to accurately control the variable shutter adjustment movement requirements including but not limited to, in/out perpendicular to a Light Axis (18), radially around a Light Axis (18), and radially around an Adjustment Contact Axis (46) with FIG. 40 elliptical Tool Opening (48) shape in combination with a Driver (100) being by way of example and not by way of limiting endless design options for combinations of an elliptical Tool Opening (48) shape with a variable Driver (100) tip shape.

Figure 41:
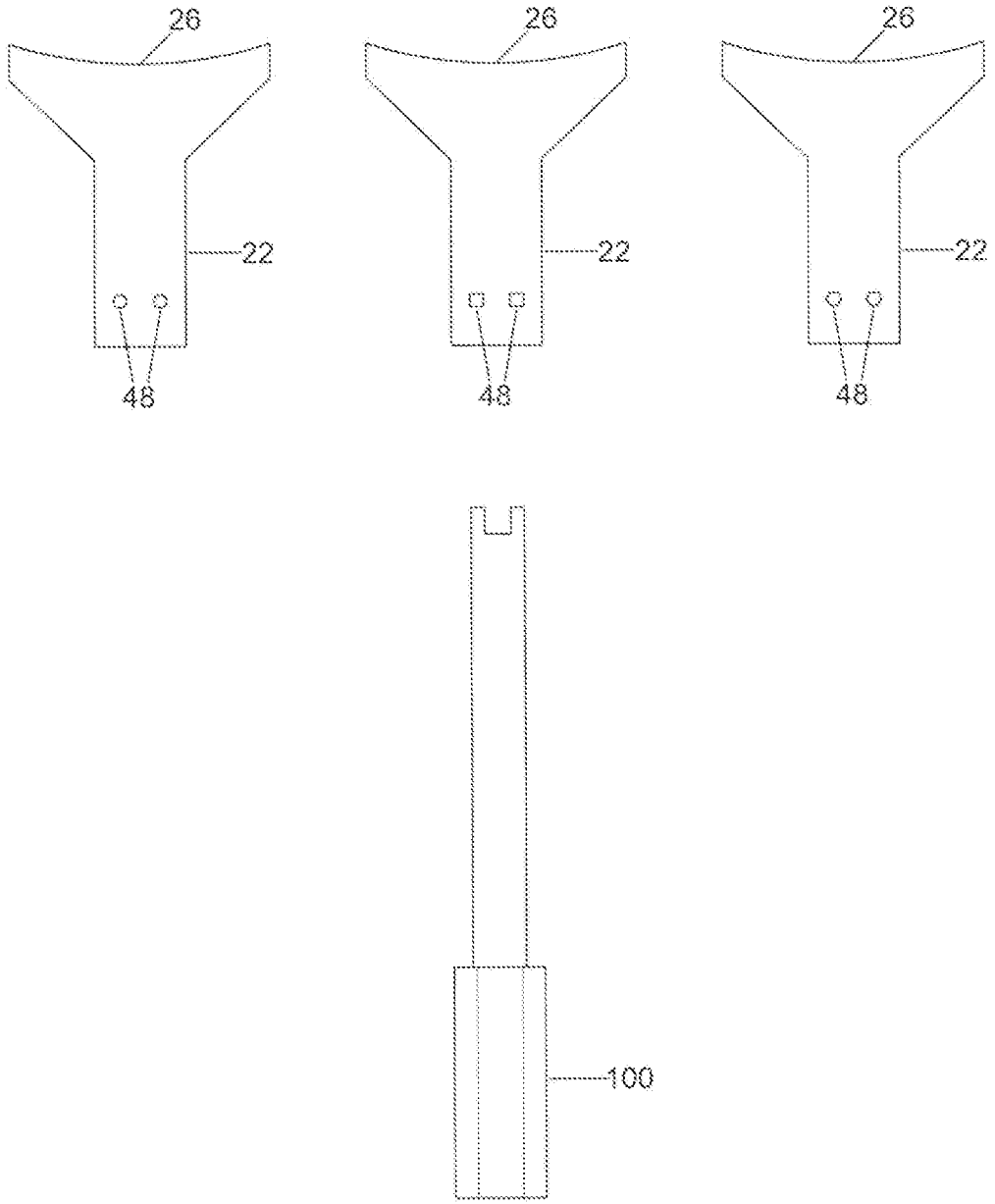
FIG. 41 depicts elevation drawings for endless dual tool opening shapes that can be integrated into a light masking shutter to receive endless dual tip driver shapes for shutter adjustment.

FIG. 41 includes elevation drawings illustrating embodiments for some of many possible dual Tool Opening (48) shapes that can be integrated into a Light Masking Shutter (22) in combination with a dual tip Driver (100), with dual Tool Opening (48) shapes if located in a position accessible for adjustment contact including when a Light Masking Shutter (22) is closed can be engaged into by a dual tip Driver (100) providing the ability to accurately control the variable shutter adjustment movement requirements including but not limited to, in/out perpendicular to a Light Axis (18), radially around a Light Axis (18), and radially around an Adjustment Contact Axis (46) with FIG. 41 dual Tool Opening (48) shapes in combination with a dual tip Driver (100) being by way of example and not by way of limiting endless design options for combinations of dual Tool Opening (48) shapes with dual tip Driver (100) tip shapes and with dual being by way of example and not by way of limiting more than two Tool Opening (48) openings on a Light Masking Shutter (22) in combination with two or more than two Driver (100) tips on a single Driver (100).

Figure 42:
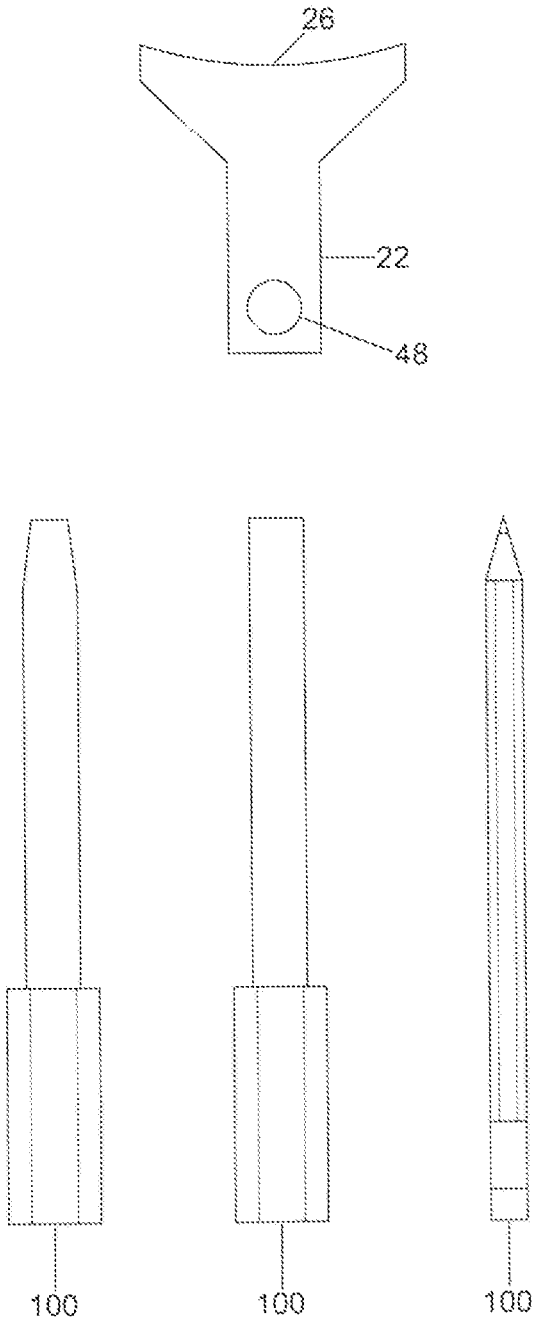
FIG. 42 depicts isometric drawings of a round tool opening shape that can be integrated into a light masking shutter to receive endless shaped driver tips for shutter adjustment.

FIG. 42 includes elevation drawings illustrating embodiments for a round Tool Opening (48) shape that can be integrated into a Light Masking Shutter (22) in combination with a Driver (100), with a round Tool Opening (48) shape if located in a position accessible for adjustment contact including when a Light Masking Shutter (22) is closed can be engaged into by a Driver (100) providing the ability to accurately control a portion of the variable shutter adjustment movement requirements including but not limited to, in/out perpendicular to a Light Axis (18), and radially around a Light Axis (18) with FIG. 42 round Tool Opening (48) shape in combination with Drivers (100) being by way of example and not by way of limiting endless design options for combinations of a round Tool Opening (48) shape and endless Driver (100) tip shapes.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims. In that regard, various features from certain of the disclosed embodiments can be incorporated into other of the disclosed embodiments to provide desired structure.

What is claimed:

1. A forward access optical framing projector assembly comprised of a light source to produce a light beam, a gate rotation sleeve, a light mask gate with a light mask slot, and an objective focal lens disposed within the path of the beam, wherein the light mask gate is retained to the gate rotation sleeve by fastening a gate-retaining ring to the gate light mask gate for circumferential rotation of the light mask gate and the gate-retaining ring simultaneously around the path of the beam independently of the gate rotation sleeve.

2. The forward access optical framing projector assembly of claim 1, wherein the gate rotation sleeve has an opening in its center that fits around an upper rim of the light mask gate.

3. The forward access optical framing projector assembly of claim 2, wherein the gate retaining ring has a circumference that is wider than the opening of the gate rotation sleeve.

4. A forward access optical framing projector assembly comprised of a gate rotational mechanism with at least one locking fastener, a light source to produce a light beam, a light mask where the light mask gate, locking fastener and gate retaining ring simultaneously rotate circumferentially around the light beam axis independently from the gate rotation sleeve, wherein the locking fastener is parallel to the optical axis of the light source, and an objective focal lens is disposed within the path of the beam.

5. The forward access optical framing projector assembly of claim 4, further comprising a light mask gate and a gate rotation sleeve, wherein the at least one locking fastener is attached to the light mask gate, so that when the at least one locking fastener moves in one direction, the locking fastener pushes against the gate rotation sleeve, thereby pushing the light mask gate away from the gate rotation sleeve, and when the at least one locking fastener moves in an opposite direction, the light mask gate moves back in the direction of the gate rotation sleeve.

6. The forward access optical framing projector assembly of claim 5, wherein movement of the light mask gate away from the gate rotation sleeve is restrained by a gate retaining ring and a flange of the gate rotation sleeve.

7. The forward access optical framing projector assembly of claim 6, wherein the light mask gate has an upper rim and wherein the height of the upper rim exceeds the height of the flange.

8. The forward access optical framing projector assembly of claim 7, wherein a gate retaining ring is attached to the upper rim, so that the flange can float between the gate retaining ring and the light mask gate.

9. The forward access optical framing projector assembly of claim 4, further comprising a light mask gate and a gate rotation sleeve, wherein the at least one locking fastener is positioned within a retainer body attached to the light mask gate, so that when the at least one locking fastener moves in one direction, the locking fastener pushes against the gate rotation sleeve, thereby pushing the light mask gate away from the gate rotation sleeve, and when the at least one locking fastener moves in an opposite direction, the light mask gate moves back in the direction of the gate rotation sleeve.

10. The forward access optical framing projector assembly of claim 9, wherein movement of the light mask gate away from the gate rotation sleeve is restrained by a gate retaining ring and a flange of the gate rotation sleeve.

11. The forward access optical framing projector assembly of claim 10, wherein the light mask gate has an upper rim and wherein the height of the upper rim exceeds the height of the flange.

12. The forward access optical framing projector assembly of claim 11, wherein a gate retaining ring is attached to the upper rim, so that the flange can float between the gate retaining ring and the light mask gate.

13. A forward access optical framing projector assembly comprised of a light source to produce a light beam, an objective focal lens disposed within the path of the beam and further comprising an independent light masking shutter locking system that includes a front cone flange with slots around the light beam axis and at least one light masking shutter that includes a shutter adjustment screw slot, and;

wherein the back side of a screw touches the front cone flange, isolating the back side of the screw from the light masking shutter such that when the screw is rotated, the position of the shutter is unchanged;

wherein the light masking shutter slot intersects the front cone flange slot;

further comprising a screw, a nut, and a groove slightly wider than an outside width across a flat of the nut, allowing the nut to travel within the groove; and further comprising a shutter gate with the groove to capture the nut from spinning.

14. The forward access optical framing projector assembly of claim 13 further containing a shutter separator plate with over sized slots for the nut to not contact the separator plate and the screw to extend through wherein a center line of the separator plate slots align with a center line of shutter gate grooves such that a pair of opposing shutters are located on the same side of the shutter separator plate.

15. The forward access optical framing projector of claim 13 with light masking shutter further comprising an adjustment tool opening shaped to receive a tool shape that provides adjustment contact for accurate shutter adjustment from an opening in the finished surface plane of a structure with projector recessed in a housing.

16. A forward access optical framing projector assembly comprised of a light source to produce a light beam, an objective focal lens disposed within the path of the beam and further comprising an independent light masking shutter locking system that includes a front cone flange with slots around the light beam axis and at least one light masking shutter that includes a shutter adjustment screw slot;

wherein the light masking shutter slot intersects the front cone flange slot;

further comprising the shutter with a nut retainer tab to capture a nut from spinning; and further comprising the screw, a nut, and the nut retainer tab having a width allowing the nut to slide and travel within the nut retainer tab, and;

wherein the back side of a screw touches the front cone flange, isolating the back side of the screw from the light masking shutter such that when the screw is rotated, the position of the shutter is unchanged.

17. The forward access optical framing projector of claim 16, with light masking shutter further comprising an adjustment tool opening shaped to receive a tool shape that provides adjustment contact for accurate shutter adjustment from an opening in the finished surface plane of a structure with projector recessed in a housing.

* * * * *